US006890193B2

(12) United States Patent
Kimura et al.

(10) Patent No.: US 6,890,193 B2
(45) Date of Patent: May 10, 2005

(54) ELECTRICAL CONNECTOR IMPROVING BOTH FUNCTIONS OF MAGNETIC SHIELDING AND GROUND CONNECTION

(75) Inventors: Akira Kimura, Kokubunji (JP); Kazuhito Hisamatsu, Akiruno (JP); Masaaki Takaku, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 140 days.

(21) Appl. No.: 10/673,944

(22) Filed: Sep. 29, 2003

(65) Prior Publication Data

US 2004/0235324 A1 Nov. 25, 2004

(51) Int. Cl.[7] ..... H01R 4/66
(52) U.S. Cl. ..... 439/108
(58) Field of Search ..... 439/108, 497, 439/579, 607–610, 493, 495, 630, 636, 578

(56) References Cited

U.S. PATENT DOCUMENTS 6,273,753 B1 * 8/2001 Ko ..... 439/579
6,544,050 B1 * 4/2003 Ko ..... 439/108
6,685,509 B1 * 2/2004 Yeh ..... 439/607

FOREIGN PATENT DOCUMENTS

| | | |
|---|---|---|
| JP | 7-22064 | 5/1995 |
| JP | 10-321302 | 12/1998 |
| JP | A-H11-283710 | 10/1999 |

* cited by examiner

*Primary Examiner*—J. F. Duverne
(74) *Attorney, Agent, or Firm*—Collard & Roe, P.C.

(57) ABSTRACT

An insulator (40) retains a plurality of conductive signal contacts (10) arrayed in a first direction (A1) for contacting with signal contacts of a counterpart connector, and further retains a conductive ground plate (20). The ground plate is arranged so as to be spaced apart from the signal contacts and has a plurality of ground contacts (24, 25) for contacting with ground contacts of the counterpart connector. These ground contacts are arrayed in the first direction and joined to each other via a joining portion (21). A connection piece (32, 33) extends from a part of the joining portion in the same direction as each of the ground contacts. The connection piece contacts with a conductive shell (60) formed separately from the ground plate and covering the insulator.

15 Claims, 24 Drawing Sheets

ELECTRICAL CONNECTOR IMPROVING BOTH FUNCTIONS OF MAGNETIC SHIELDING AND GROUND CONNECTION

This application claims priority to prior Japanese patent applications JP 2003-118486 and JP 2003-120498, the disclosures of which are incorporated herein by reference.

BACKGROUND OF THE INVENTION

The present invention relates to an electrical connector (hereinafter also referred to simply as "connector") having a plurality of conductive contacts and an insulator retaining or holding those contacts.

Recently, a connector has been required to have a magnetic shielding function depending on a use thereof. For example, JP-A-H11-283710 describes a connector having a magnetic shielding function. This connector is used for connecting a connection object such as a cable and comprises an insulator, conductive signal contacts arrayed on one side of the insulator, a conductive ground plate disposed on the other side of the insulator, and a conductive shell covering the insulator.

Two types of ground plates are disclosed in the publication each for use in the foregoing connector. One type of the ground plate is in contact with the shell and is connected to the ground of a connection object via the shell. However, it is not provided with particular means for connection to ground contacts of a counterpart connector. The other type of the ground plate is provided with ground contacts for connection to ground contacts of a counterpart connector, but no consideration is given about connection to the shell.

Nevertheless, the ground plate and the shell contribute to magnetic shielding and ground connection of the connector, but, further improvement thereof has been expected.

SUMMARY OF THE INVENTION

It is therefore an object of the present invention to provide an electrical connector that is excellent in electrical characteristic with enhanced functions of both magnetic shielding and ground connection.

Other objects of the present invention will become clear as the description proceeds.

According to one aspect of the present invention, there is obtained an electrical connector comprising a plurality of conductive signal contacts arrayed in a first direction for contacting with signal contacts of a counterpart connector; a conductive ground plate comprising a plurality of first ground contacts arrayed in the first direction for contacting with second ground contacts of the counterpart connector, and a joining portion joining the first ground contacts together; an insulator retaining the first signal contacts and the ground plate so as to be spaced apart from each other; a conductive shell formed separately from the ground plate and covering the insulator; and a connection structure electrically connecting the joining portion to the shell, the connection structure comprising a first connection piece extending from a part of the joining portion in the same direction as each of the first ground contacts in a second direction perpendicular to the first direction, and contacting with the shell.

According to another aspect of the present invention, there is obtained an electrical connector comprising a plurality of signal contacts; a ground plate; an insulator retaining the signal contacts and the ground plate; and a shell covering the insulator, wherein the shell has an engaging portion and the ground plate has a to-be-engaged portion, and wherein the shell is mounted to the insulator in an insert direction of a counterpart connector into the connector and the ground plate is mounted to the insulator in a direction opposite to the insert direction so that the engaging portion and the to-be-engaged portion engage with each other.

DESCRIPTION OF THE PREFERRED EMBODIMENTS

Figure 1:
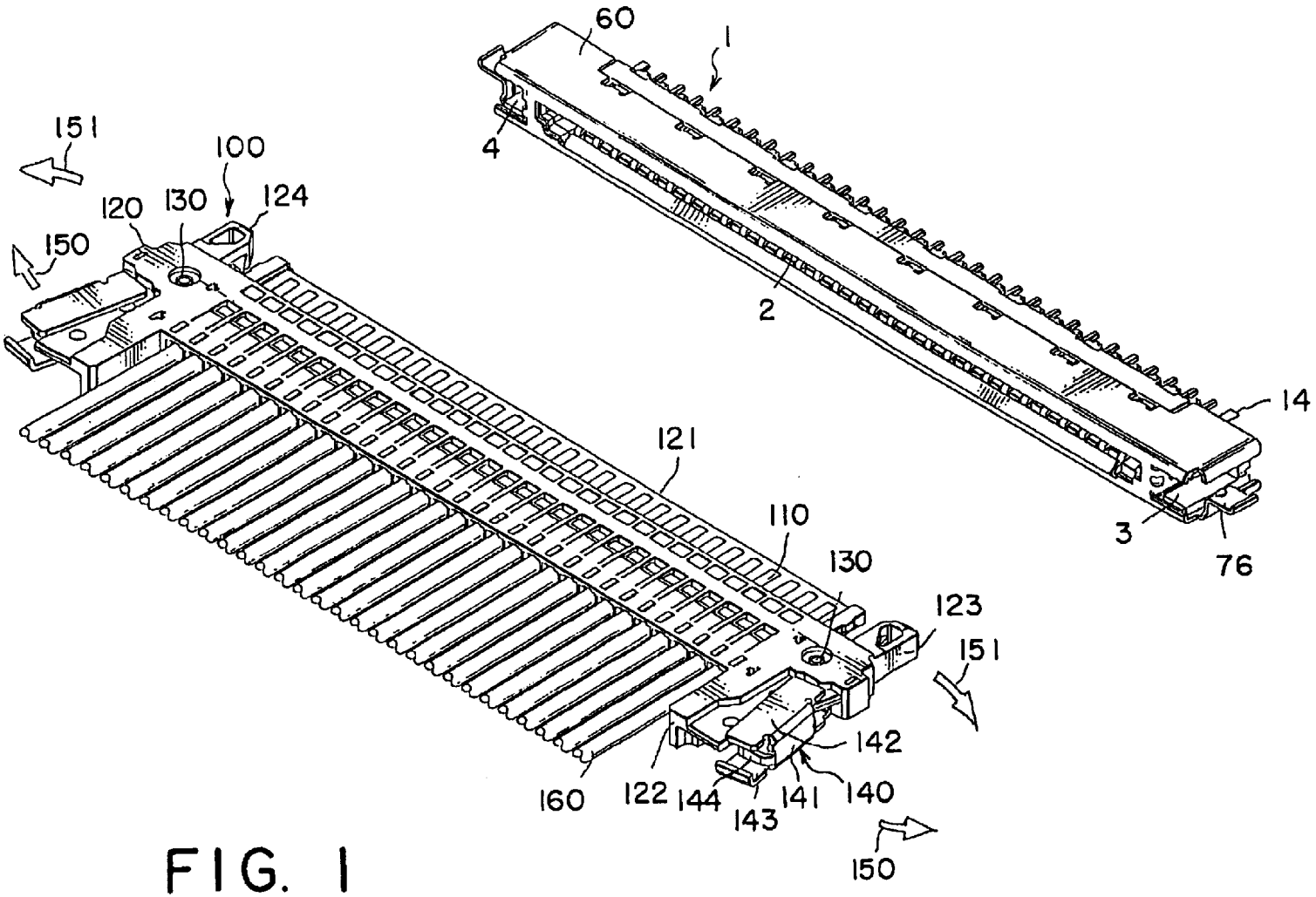
FIG. 1 is a perspective view showing a connector according to a first preferred embodiment of the present invention, along with a counterpart connector.
Figure 2:
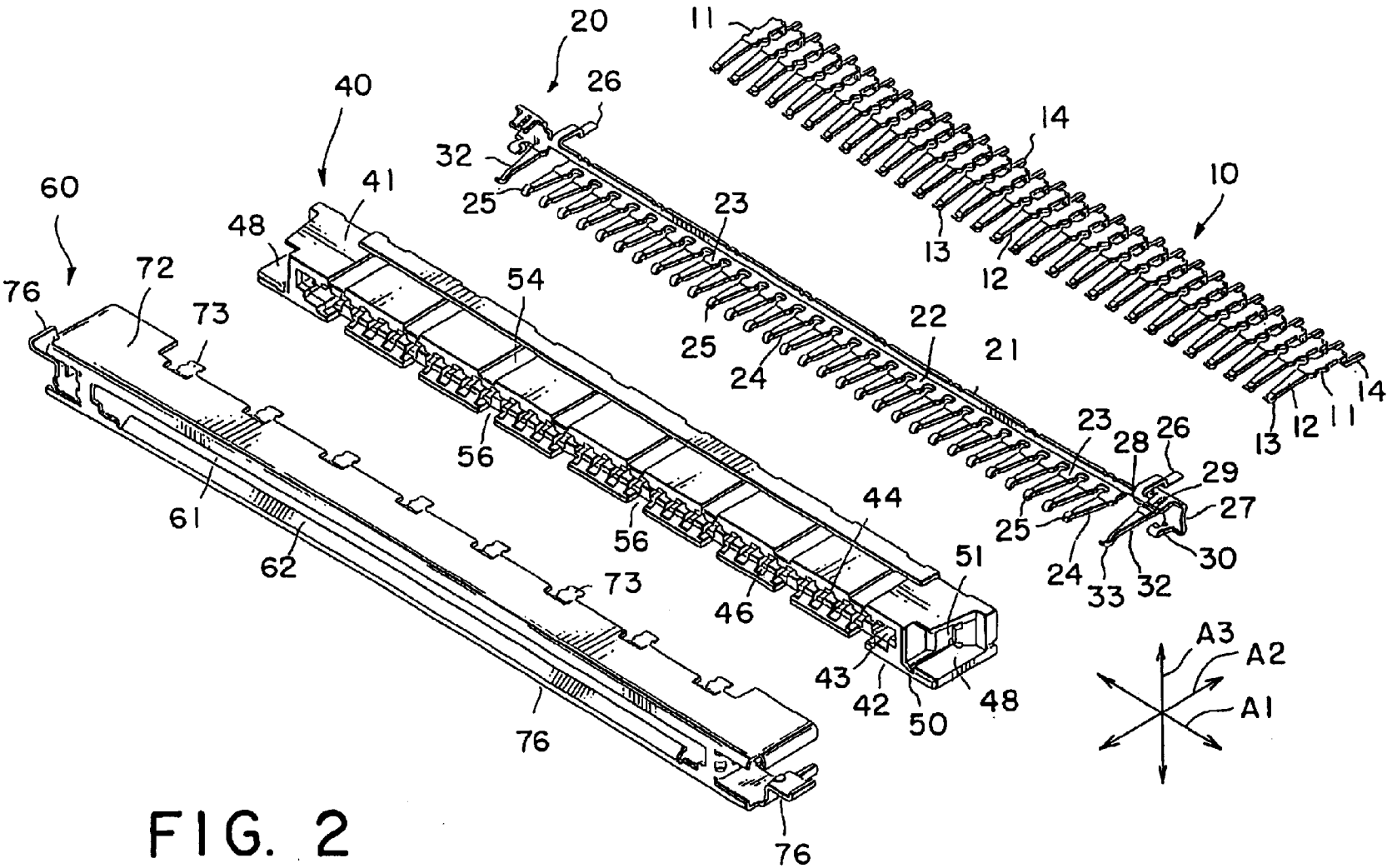
FIG. 2 is an exploded perspective view of the connector shown in FIG. 1.

Referring to FIGS. 1 to 4, description will be made about an overall structure of a connector according to a first preferred embodiment of the present invention.

The shown connector 1 is used so as to be mounted on the back of an LCD panel or the like and fitted together with a counterpart connector connected to wiring from a device body, thereby to transmit electrical signals from the device body to the LCD panel.

The connector 1 comprises a plurality of conductive signal contacts (hereinafter also referred to simply as "contacts") 10 arrayed in a constant pitch in a first direction A1, a conductive ground plate 20, an insulator 40 retaining or holding the contacts 10 and the ground plate 20, and a conductive shell 60 covering the insulator 40. The contacts 10 are arranged at regular intervals in a longitudinal direction of the connector 1, i.e. in the first direction A1.

Each of the contacts 10 is formed by pressing a metal plate and then bending it, and comprises a press-fit portion 11, a spring portion 12 extending from the press-fit portion 11 in a second direction A2 perpendicular to the first direction A1, a contacting portion 13 that is subjected to bending so as to be curved at a free end of the spring portion 12, and a terminal portion 14 for soldering extending from the press-fit portion 11 in an opposite direction. Herein, the spring portion 12 and the contacting portion 13 are collectively called a signal contact contacting portion.

The ground plate 20 is disposed so as to be spaced apart from the contacts 10 in a third direction A3 perpendicular to the first and second directions A1 and A2. The ground plate 20 comprises a first joining portion (vertical portion) 21 in the form of a plate elongated in the first direction A1, a second joining portion (horizontal portion) 22 that is bent from the first joining portion 21 substantially at a right angle thereto, a plurality of ground press-fit portions 23 arrayed in a constant pitch in the first direction A1 and each extending from the second joining portion 22 in the second direction A2, a plurality of ground spring portions 24 each further extending from the corresponding ground press-fit portion 23, and a plurality of ground contacting portions 25 each subjected to bending so as to be curved toward the contact 10 in a plane perpendicular to the first direction A1 at a free end of the corresponding ground spring portion 24. Herein, the ground spring portion 24 and the ground contacting portion 25 are collectively called a ground contact. The signal contacts 10 and the ground contacts are arranged so as to confront each other in the third direction A3.

The ground plate 20 further comprises ground terminal portions 26 formed near both ends thereof in the first direction A1 and each extending from the first joining portion 21 in a direction opposite to that of the ground spring portion 24, and clip portions 27 formed at both ends, in the first direction A1, of the ground plate 20. Each clip portion 27 has an upper spring portion 28 and a lower spring portion 30 confronting each other in the third direction A3. The upper spring portion 28 and the lower spring portion 30 extend in the same direction as each ground spring portion 24.

Figure 5:
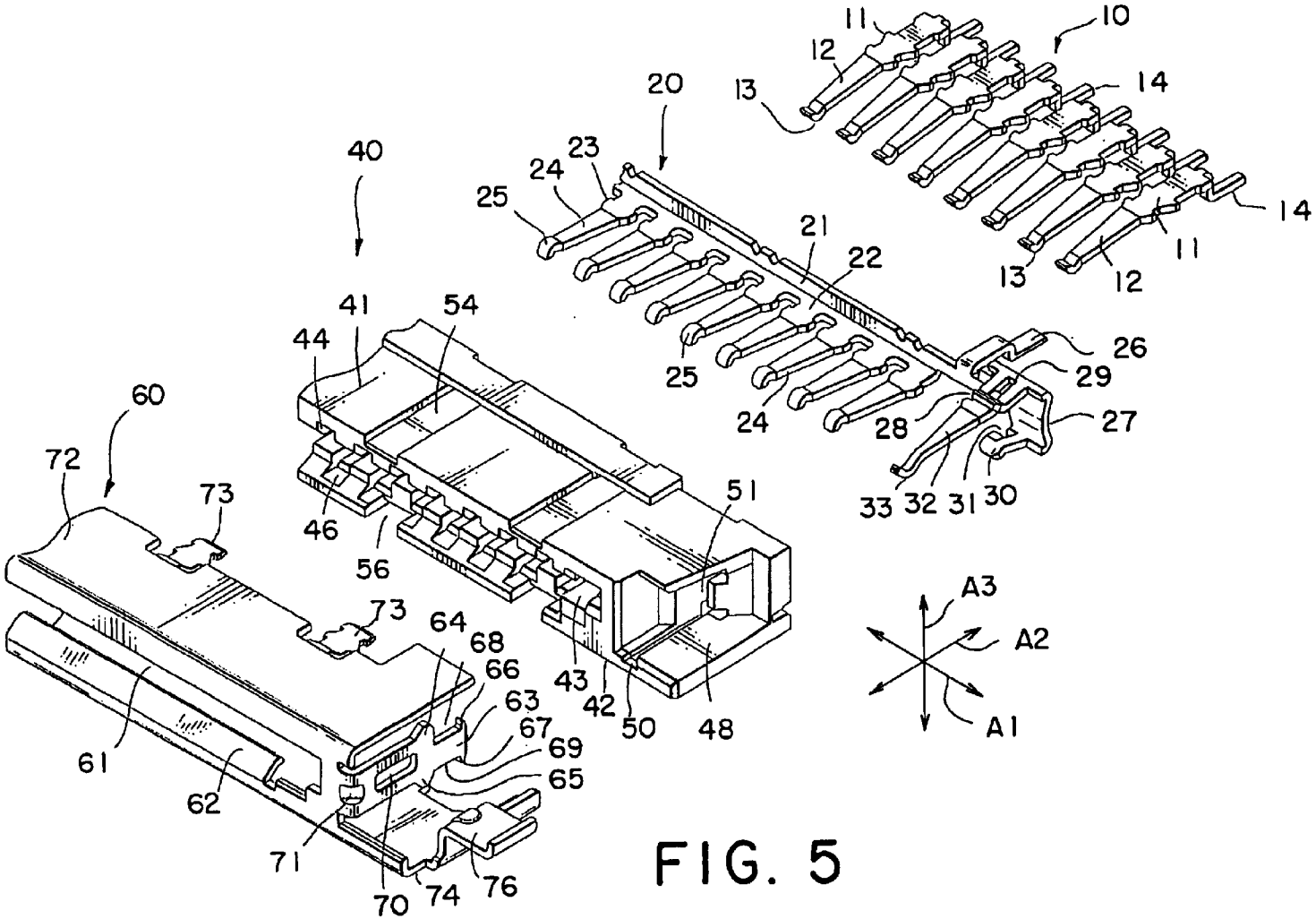
FIG. 5 is an enlarged perspective view showing the main part of the connector shown in FIG. 2, wherein part of a shell of the connector is omitted.
Figure 6:
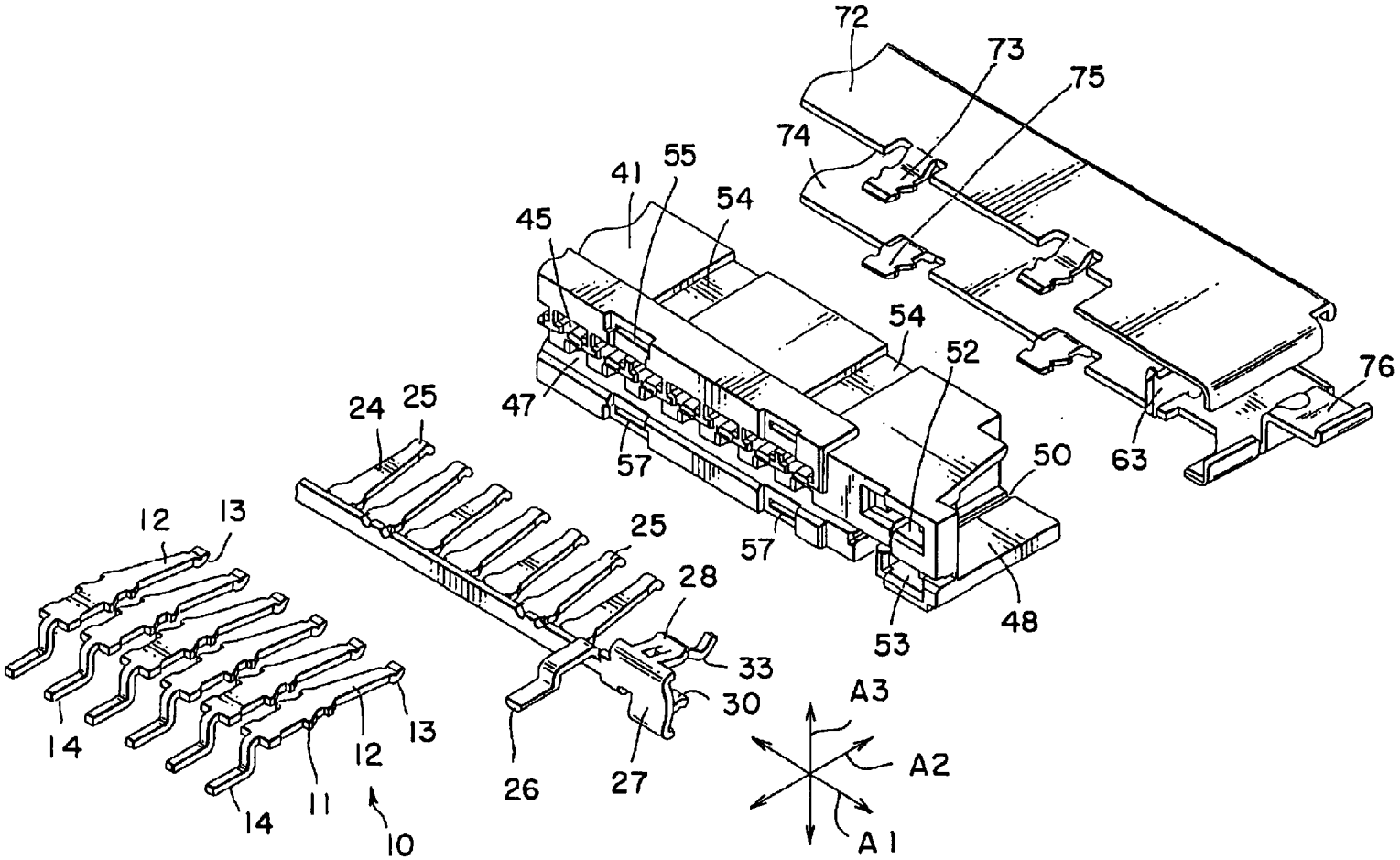
FIG. 6 is an enlarged perspective view of the main part of the connector shown in FIG. 3.

Referring also to FIGS. 5 and 6, the connector I will be described in detail.

The upper spring portion 28 of each clip portion 27 is formed with a hole portion 29, while the lower spring portion 30 thereof is formed with a cutout 31. Between each of the ground terminal portions 26 and the adjacent clip portion 27, an additional ground spring portion 32 extends in the same direction as each ground spring portion 24. At a free end of the additional ground spring portion 32, an additional ground contacting portion 33 is formed in a shape that is curved in a direction opposite to that of the ground contact 25. Herein, the additional ground spring portion 32 and the additional ground contacting portion 33 are collectively called a first connection piece.

Figure 3:
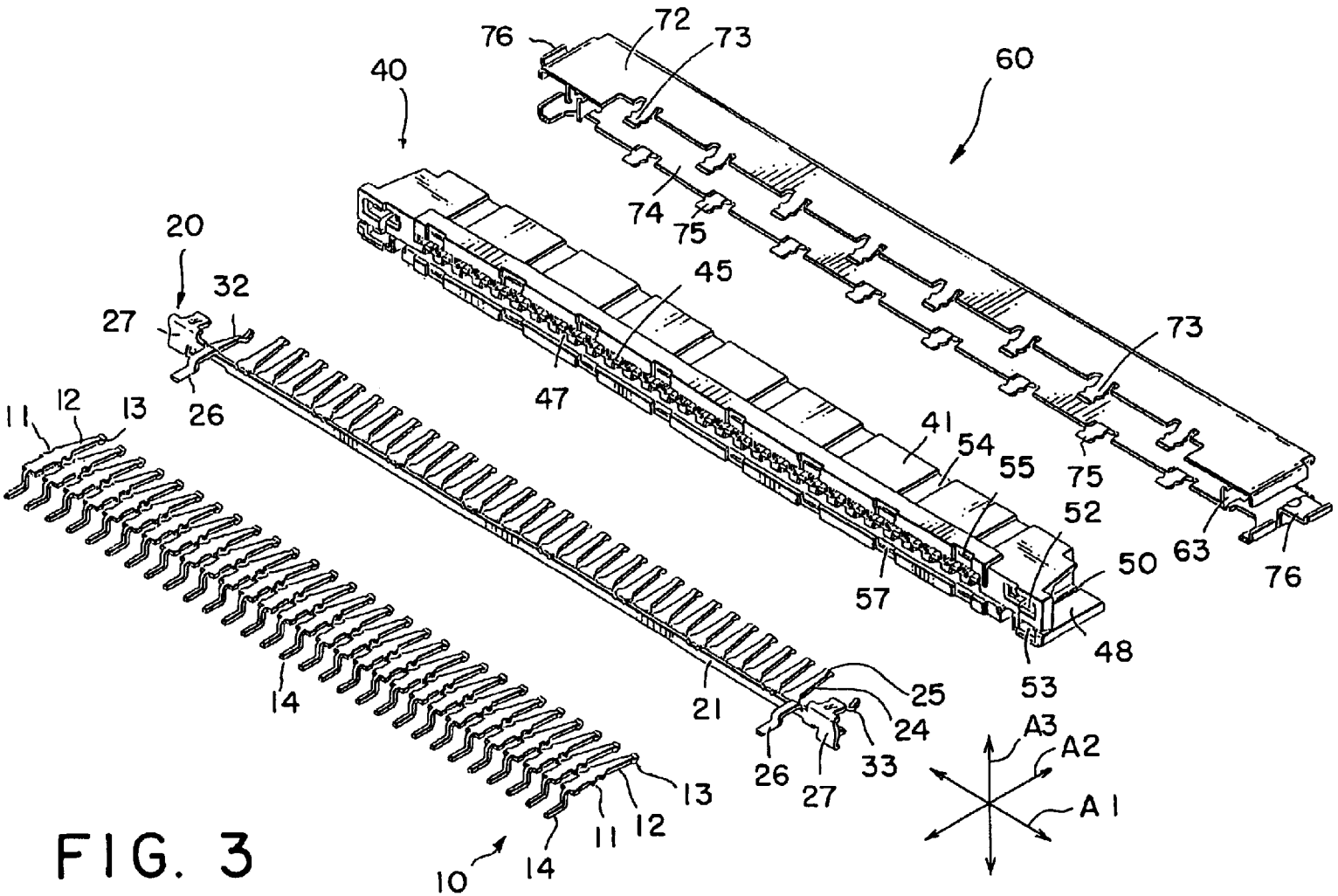
FIG. 3 is a perspective view seen from the back side of the connector shown in FIG. 2.

The insulator 40 is made of a non-conductive material such as resin. A fitting hole 43 is formed between an upper surface portion 41 and a lower surface portion 42 of the insulator 40. Contact receiving grooves 44 are formed on an inner surface of the upper surface portion 41, i.e. on an upper wall surface of the fitting hole 43, while ground receiving grooves 46 are formed on an inner surface of the lower surface portion 42, i.e. on a lower wall surface of the fitting hole 43. As best shown in FIGS. 3 and 6, a contact receiving hole 45 is formed at a longitudinally rear end of each contact receiving groove 44. As best shown in FIGS. 3 and 6, a ground receiving hole 47 is formed at a longitudinally rear end of each ground receiving groove 46.

Recessed portions 48 are formed at both ends of the insulator 40 in the first direction A1. A groove 49 is formed on an upper wall surface of the recessed portion 48, a groove 50 is formed on a lower wall surface thereof, and a shell hole 51 is formed in a back wall thereof. A hole 52 is formed in the back wall at a longitudinally rear end of the groove 49, and a hole 53 is formed in the back wall at a longitudinally rear end of the groove 50.

Figure 4:
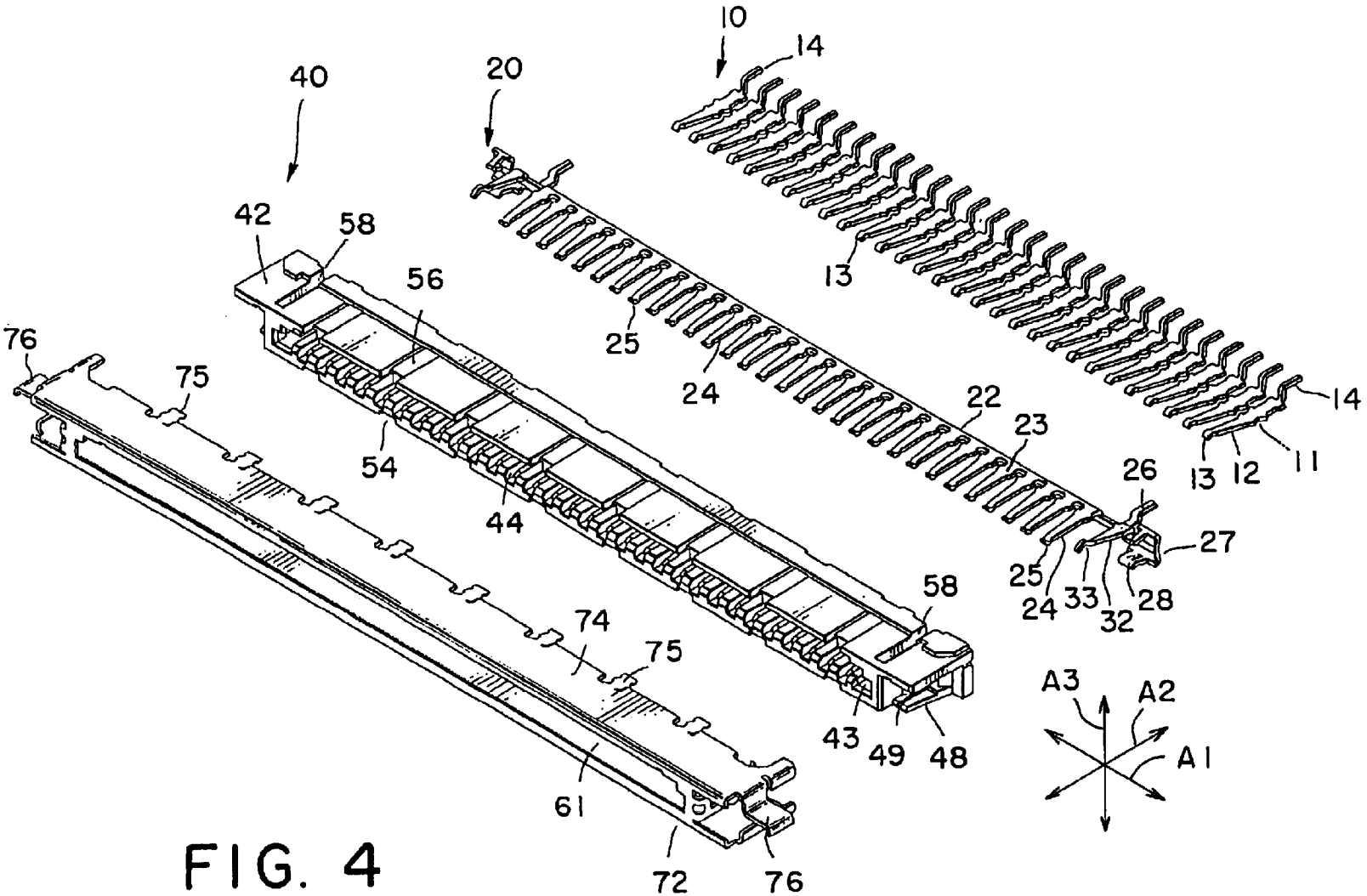
FIG. 4 is a perspective view seen from the lower side of the connector shown in FIG. 2.

Shell retaining grooves 54 are formed on the upper surface portion 41 of the insulator 40, and shell retaining grooves 56 are formed on the lower surface portion 42 thereof. Shell engaging holes 55 and 57 are formed at longitudinally rear ends of the shell retaining grooves 54 and 56, respectively. Further, the lower surface portion 42 is formed with a pair of slits 58 at both end portions thereof in the first direction A1 as shown in FIG. 4.

The shell 60 covers the insulator 40. Therefore, the contacts 10 and the ground plate 20 are also covered with the shell 60. The shell 60 is a pressed component having a substantially ⊐-shape in a section perpendicular to the first direction A1, and is formed with a fitting hole 61 in the front thereof and with a guide surface 62 on a lower side of the fitting hole 61.

As best seen from FIGS. 5 and 6, on both outer sides of the fitting hole 61 are formed folded portions 63 each of which is bent so as to get into a space between mutually parallel upper and lower plates 72 and 74 of the shell 60. The folded portion 63 extends in the second direction A2 and is formed near its center in an extending direction thereof with convex portions 64 and 65 projected in the third directions A3. Edge portions 66 and 67 are formed at a free end of the folded portion 63. Concave portions 68 and 69 are formed between the convex portions 64 and 65 and the edge portions 66 and 67. Further, the folded portion 63 is formed with a lock hole 70 and a rib 71.

The upper plate 72 of the shell 60 is formed with shell press-fit portions 73, and the lower plate 74 thereof is formed with shell press-fit portions 75. Both longitudinal ends of the lower plate 74 are extended to have shell terminal portions 76 for soldering, respectively.

Now, referring to FIGS. 1 to 7, assembling of the connector 1 will be described.

Figure 7:
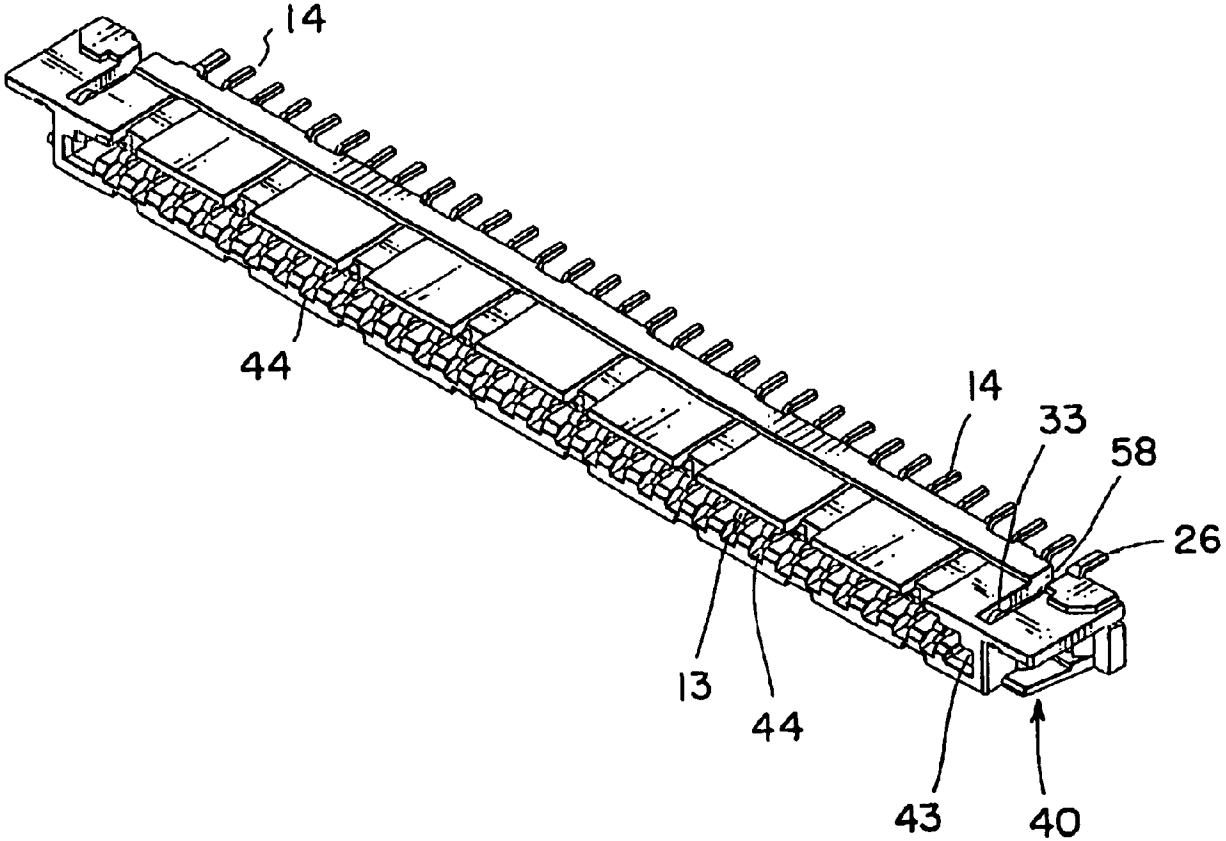
FIG. 7 is a perspective view showing the state wherein the components, excluding the shell, of the connector shown in FIG. 2 are assembled.
Figure 8:
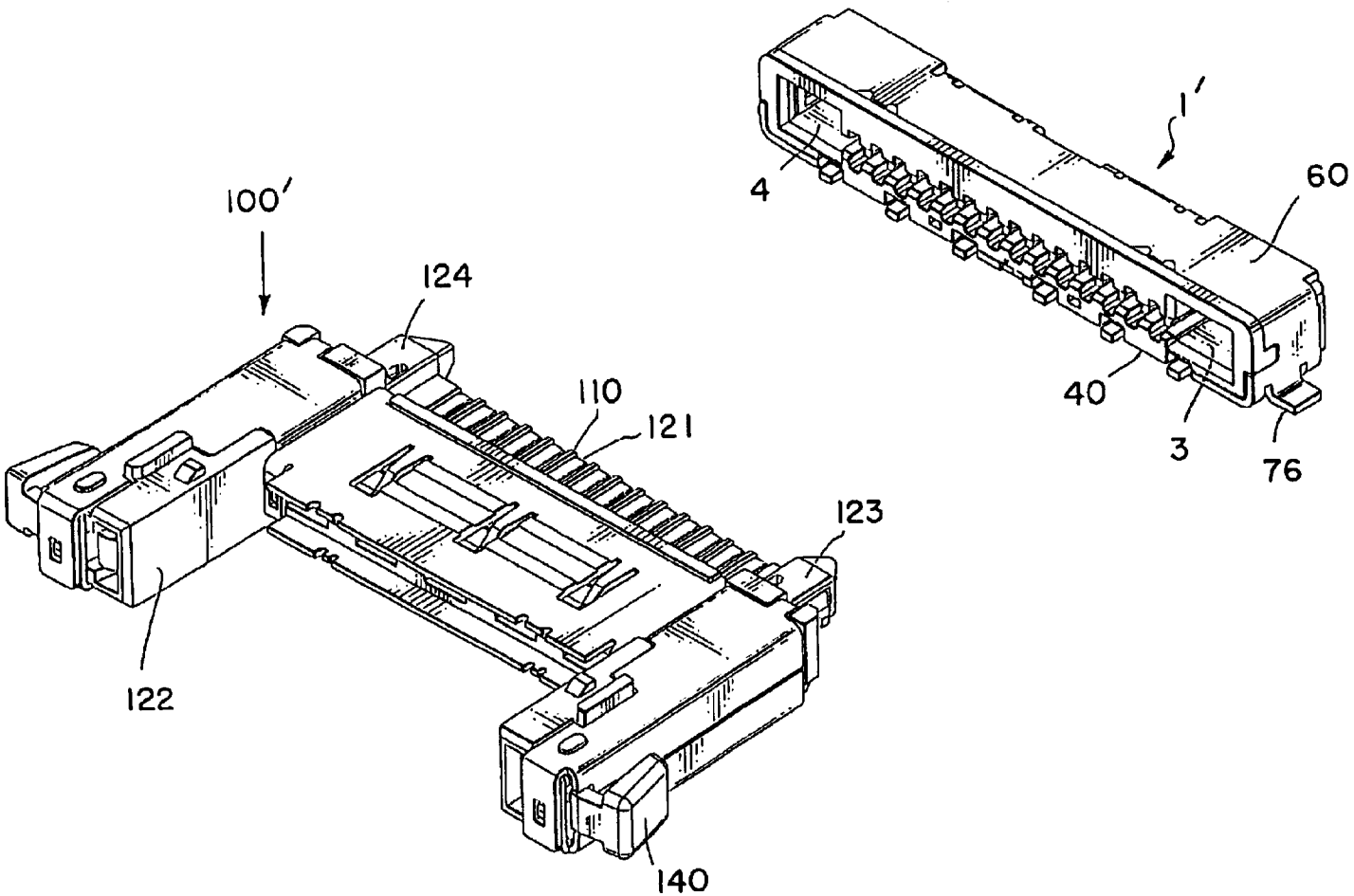
FIG. 8 is a perspective view showing a connector according to a second preferred embodiment of the present invention, along with a counterpart connector.
Figure 9:
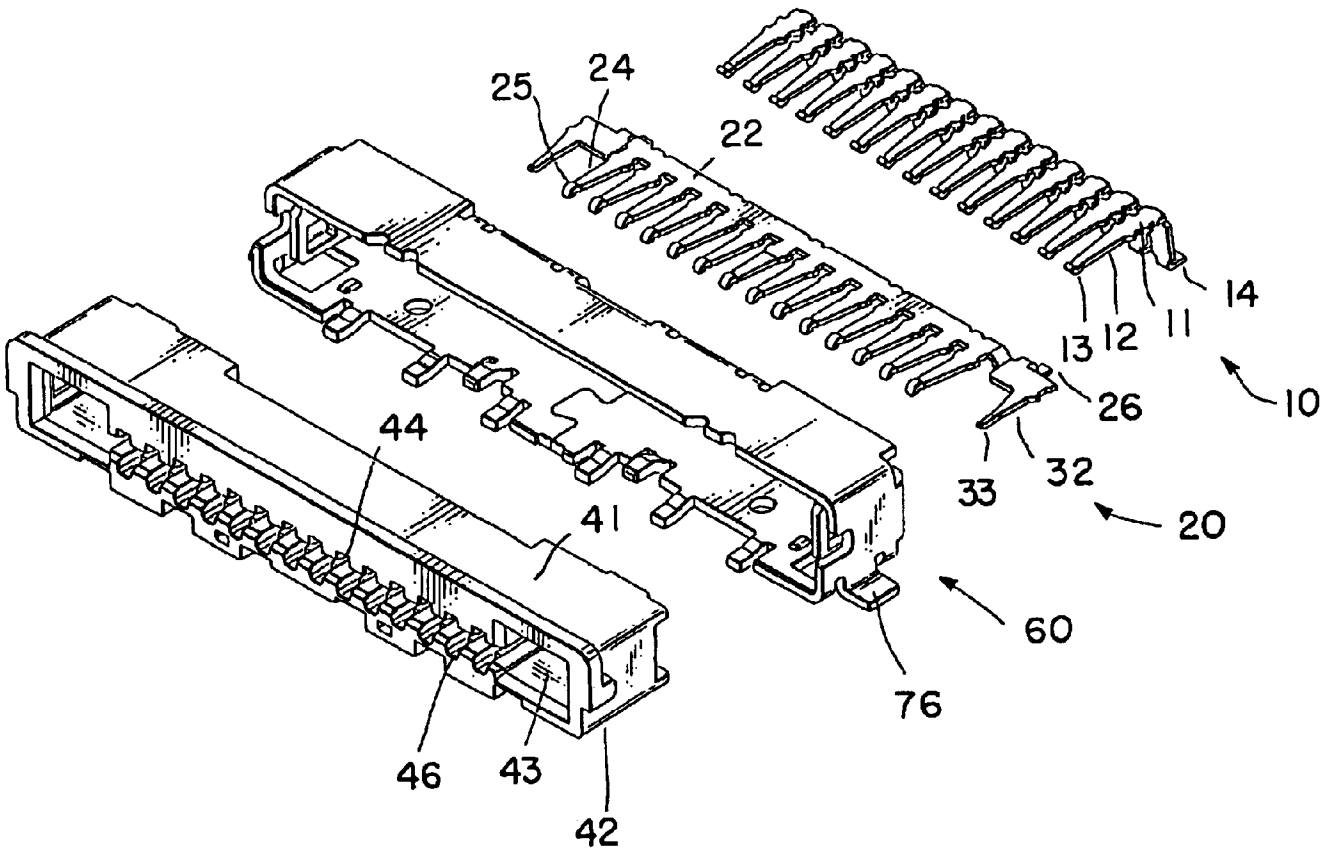
FIG. 9 is an exploded perspective view of the connector shown in FIG. 8.
Figure 10:
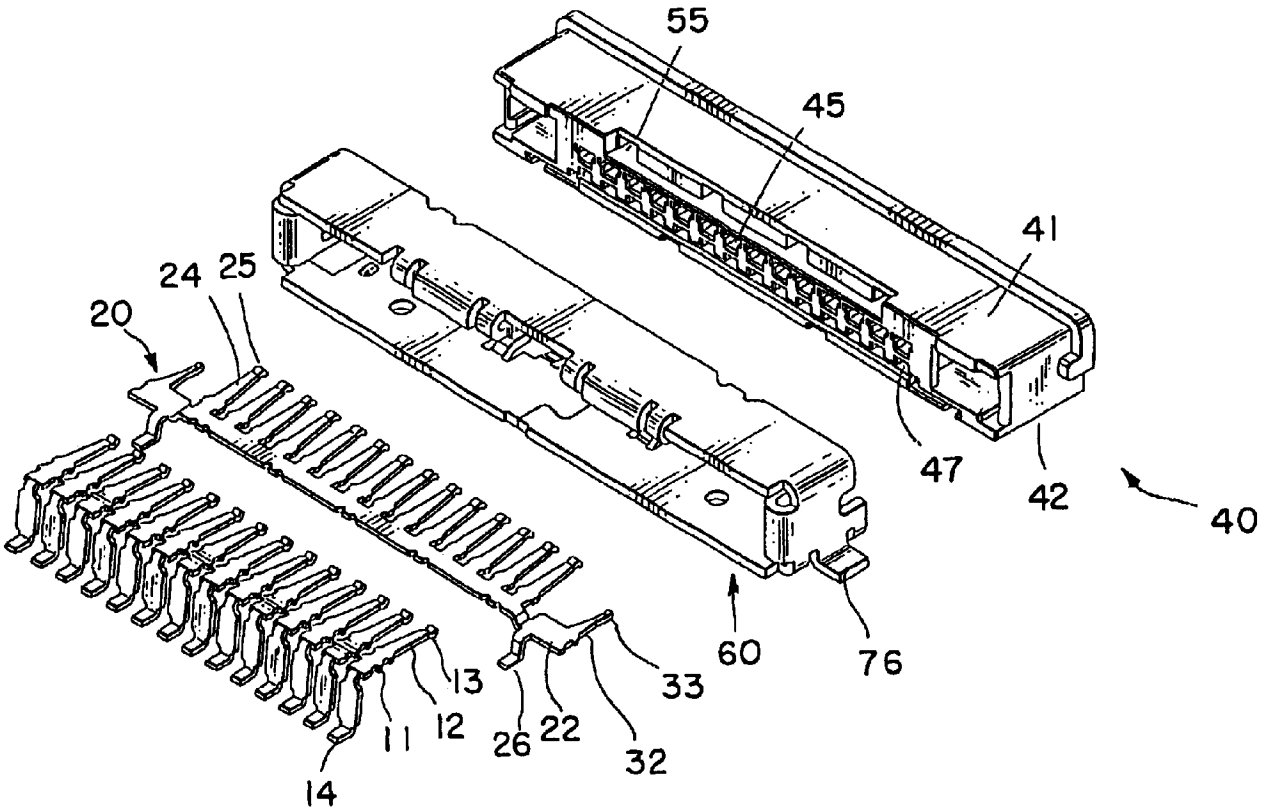
FIG. 10 is a perspective view seen from the back side of the connector shown in FIG. 9.
Figure 11:
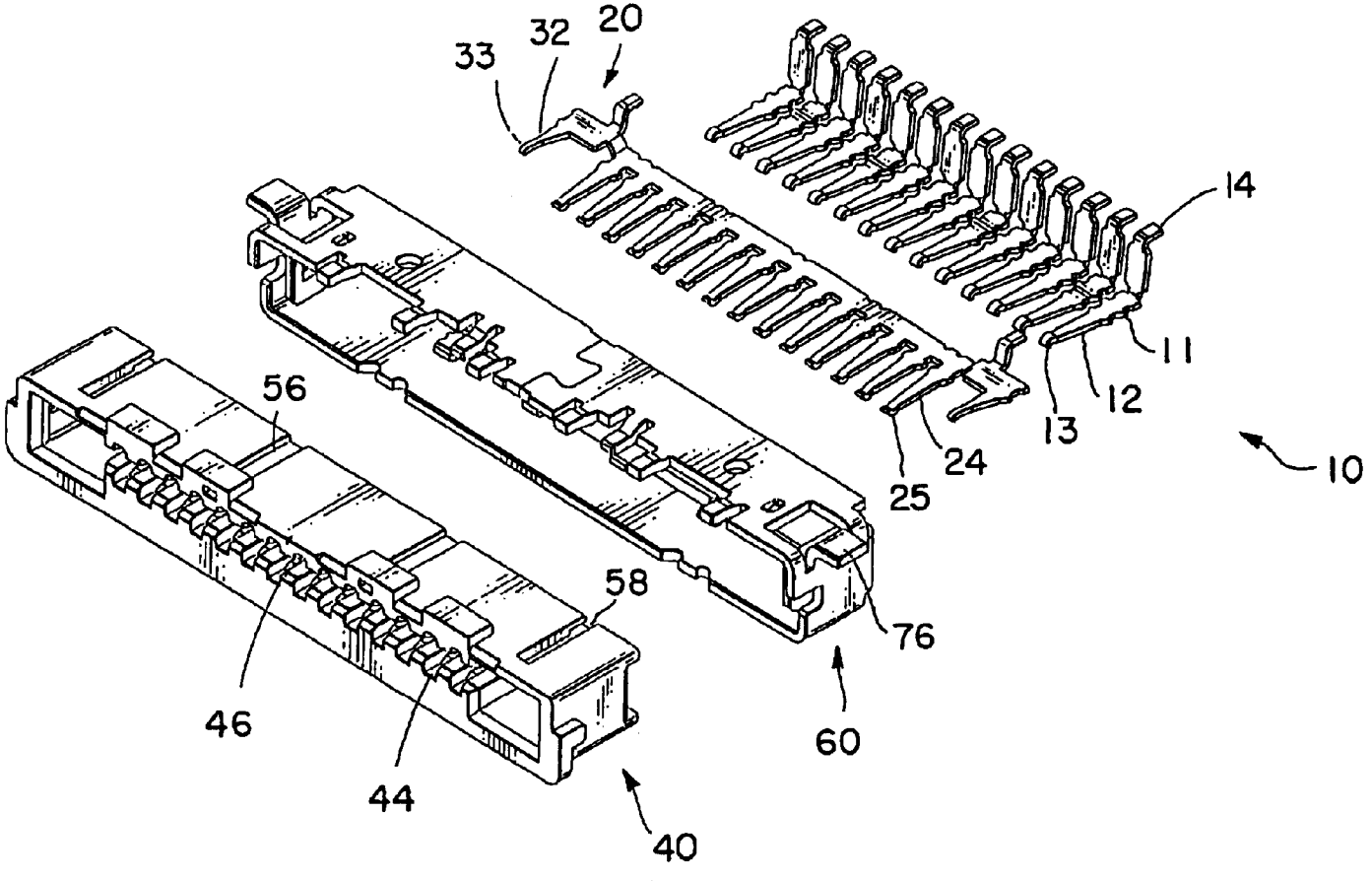
FIG. 11 is a perspective view seen from the lower side of the connector shown in FIG. 10.
Figure 12:
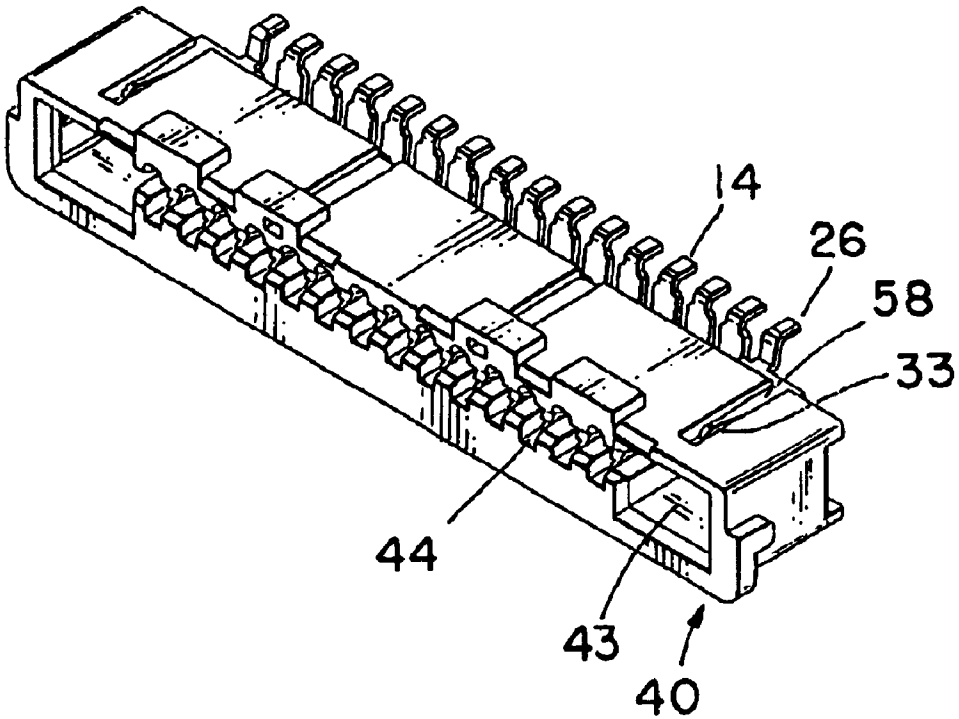
FIG. 12 is a perspective view showing the state wherein components, excluding a shell, of the connector shown in FIG. 8 are assembled.
Figure 13:
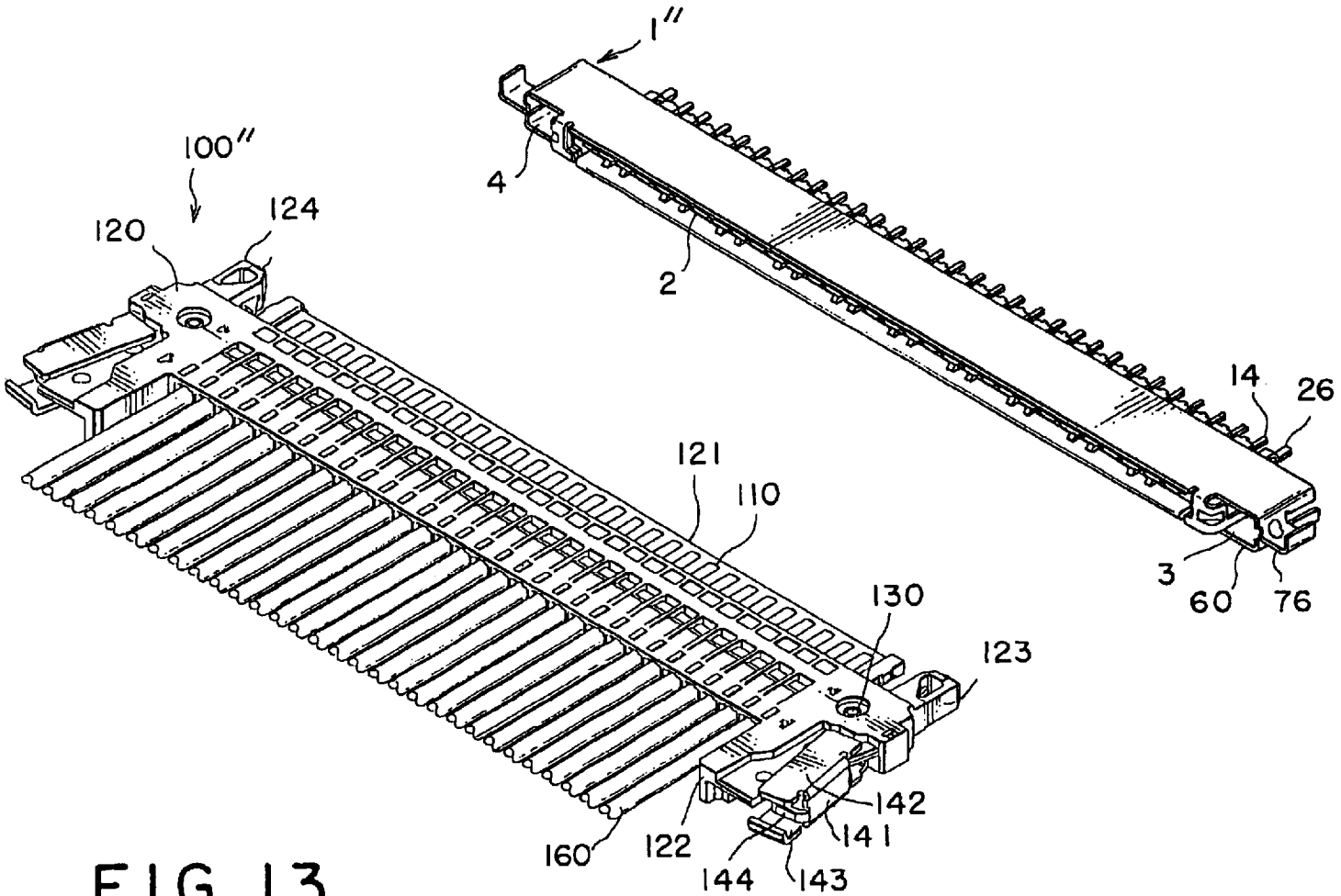
FIG. 13 is a perspective view showing a connector according to a third preferred embodiment of the present invention, along with a counterpart connector.
Figure 14:
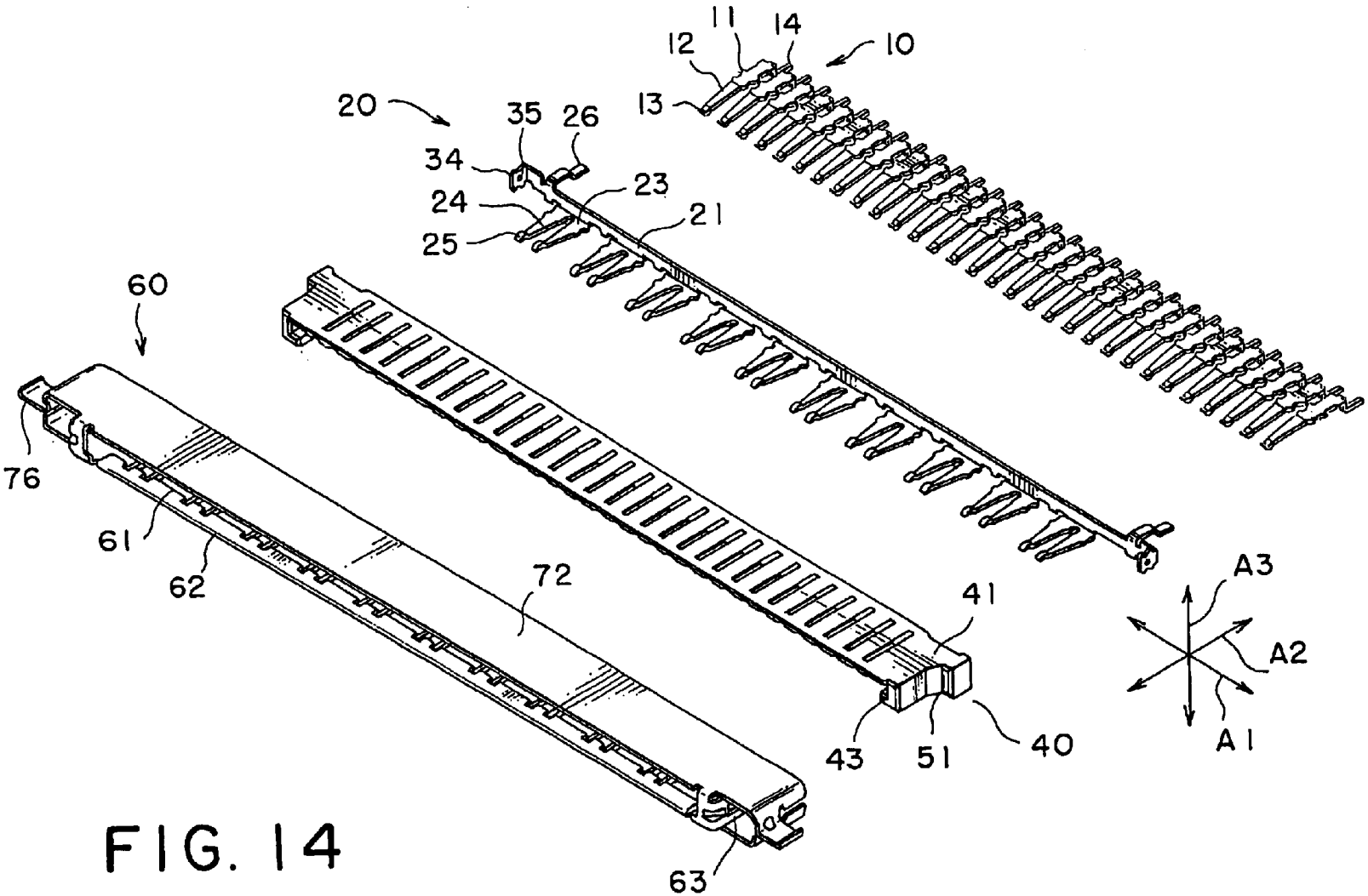
FIG. 14 is an exploded perspective view of the connector shown in FIG. 13.
Figure 15:
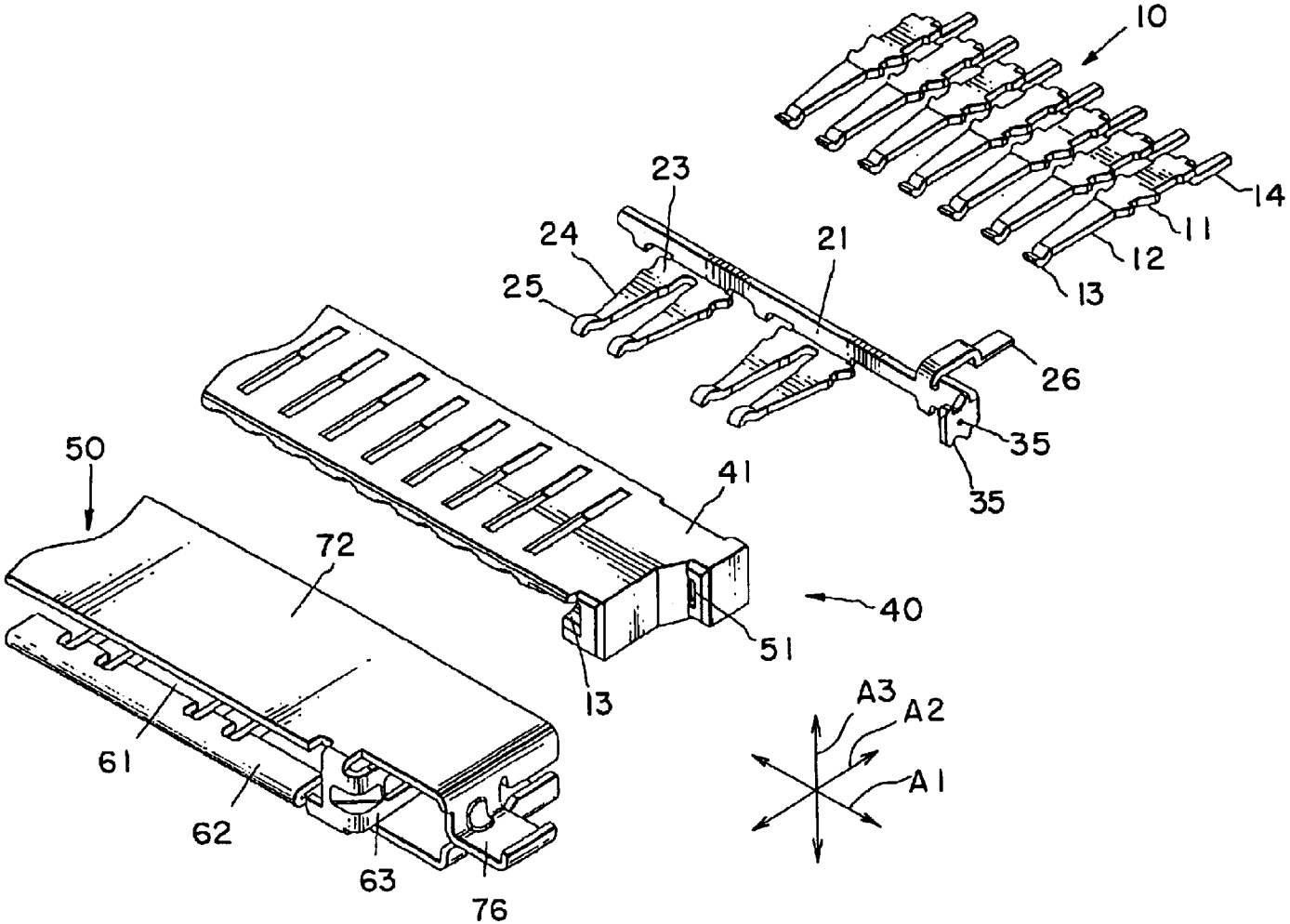
FIG. 15 is an enlarged perspective view of the main part of the connector shown in FIG. 14.
Figure 16:
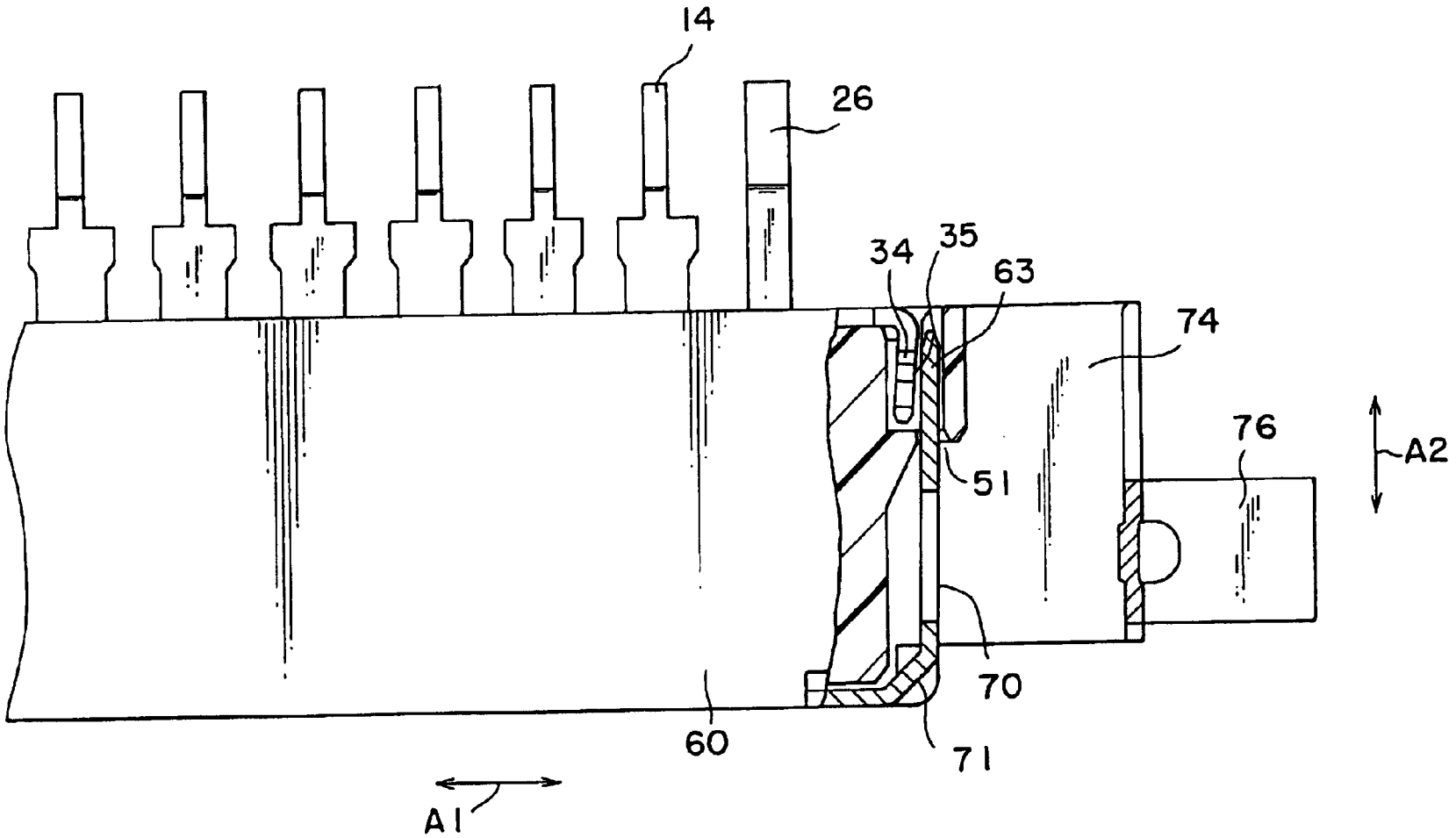
FIG. 16 is an enlarged partly-sectioned plan view, seen from the upper side, of the main part of the connector shown in FIG. 13.
Figure 17:
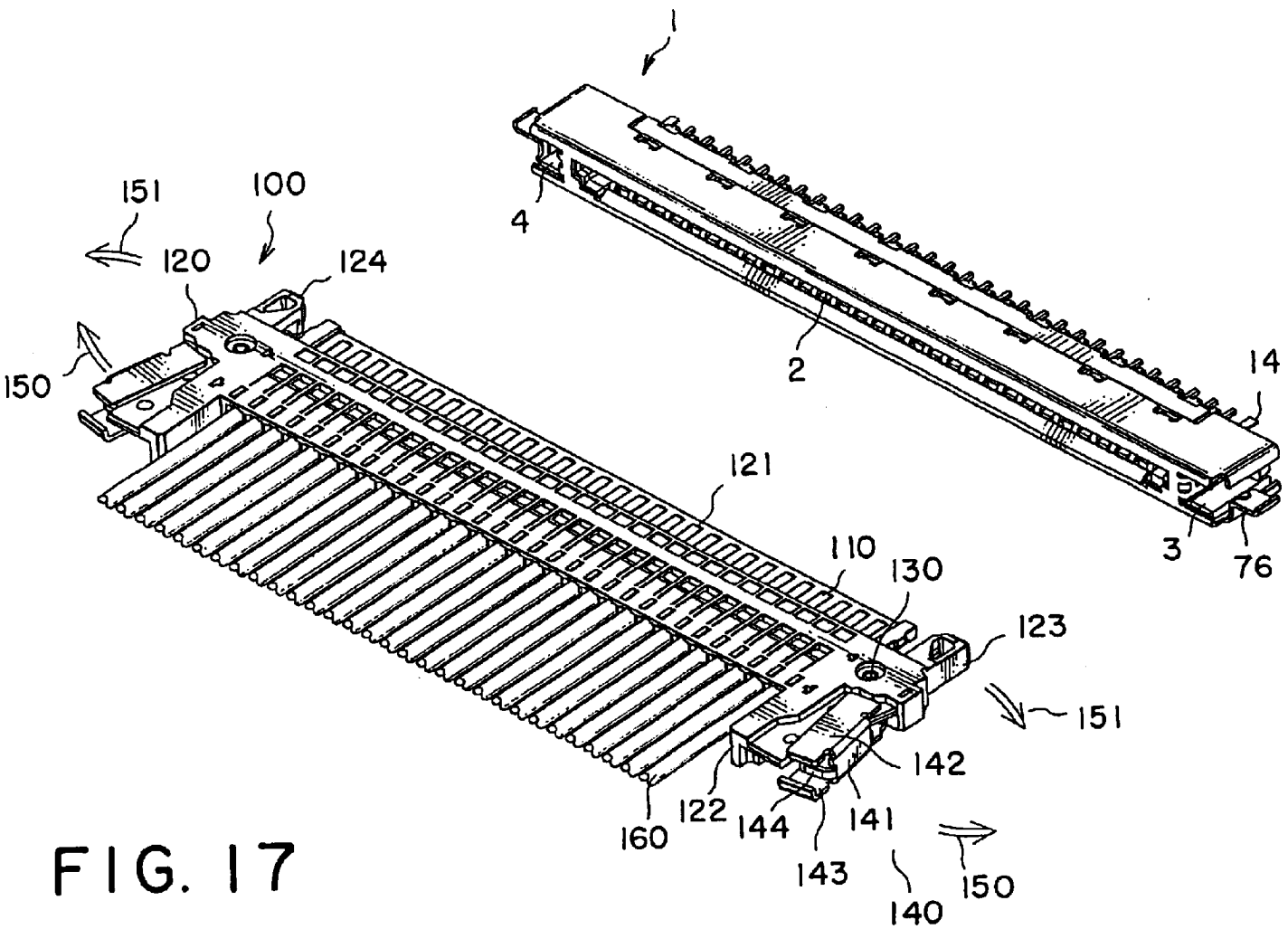
FIG. 17 is a perspective view showing a connector according to a fourth preferred embodiment of the present invention, along with a counterpart connector.

The contacts 10 are press-fitted into the contact holes 45, respectively, thereby to be fixed in the state of being arrayed in the first direction A1. The ground plate 20 is mounted into the insulator 40 from the back side in the second direction A2. As a result, the ground press-fit portions 23 of the ground plate 20 are press-fitted into the ground receiving holes 47 of the insulator 40 so as to be fixed. In this event, the upper spring portions 28 of the clip portions 27 are fitted into the holes 52 of the insulator 40, respectively, the lower spring portions 30 are fitted into the holes 53 of the insulator 40, respectively, and the additional ground spring portions 32 are fitted into the slits 58, respectively. In this event, as shown in FIG. 7, the additional ground contacting portion 33 formed at the free end of each additional ground spring portion 32 is projected over the lower surface portion 42 of the insulator 40.

The shell 60 is mounted onto the insulator 40 from the front side in the second direction A2. As a result, the press-fit portions 73 and 75 of the shell 60 pass through the shell retaining grooves 54 and 56 of the insulator 40 so as to be press-fitted into the shell holes 55 and 57 and thus fixed. Upon mounting the shell 60 onto the insulator 40, the convex portions 64 enter the grooves 49, respectively, and the convex portions 65 enter the grooves 50, respectively. Therefore, each folded portion 63 is fixed in position in the first direction A1, while the free end thereof passes through the shell hole 51. When the folded portion 63 passes through the shell hole 51, the edge portion 66 passes through the upper spring portion 28 of the clip portion 27 of the ground plate 20 and then enters the hole portion 29 of the clip portion 27 so that the upper spring portion 28 comes in contact with the convex portion 68. On the other hand, the edge portion 67 passes through the lower spring portion 30 and then enters the cutout 31 so that the lower spring portion 30 comes in contact with the concave portion 69.

The additional ground contacting portions 33 of the ground plate 20 are projected from the lower surface portion 42 of the insulator 40, and thus are pressed against an inner surface of the lower plate 74 of the shell 60 due to springiness of the additional ground spring portions 32. Therefore, the ground plate 20 and the shell 60 are electrically connected to each other.

Referring particularly to FIG. 1, a counterpart connector 100 serving as a connection counterpart of the connector 1 comprises counterpart contacts 110, a counterpart insulator 120, pins 130, levers 140, and a ground shell (not shown), and electrical wires are connected to the counterpart contacts 110.

The counterpart insulator 120 comprises a plate-like counterpart fitting portion 121, a body portion 122, and guide post portions 123 and 124. The conductive ground shell (not shown) is mounted onto the back side of the counterpart fitting portion 121. When the connector 1 and the counterpart connector 100 are filled together, the counterpart fitting portion 121 is sandwiched between the contacts 10 and the ground plate 20 confronting the counterpart fitting portion 121 and arranged in the first direction A1.

The connector 1 is provided with a fitting hole 2 for receiving therein the counterpart fitting portion 121 of the counterpart connector 100, and with post holes 3 and 4 for receiving therein the guide post portions 123 and 124 of the counterpart connector 100, respectively. At both ends of the body portion 122 of the counterpart insulator 120, the levers 140 are mounted so as to be pivotable about the pins 130, respectively.

Each lever 140 is formed by pressing a metal plate. The lever 140 has both side portions serving as an operating portion 141 and is mounted so as to sandwich the body portion 122 of the counterpart insulator 120 between upper and lower surface portions 142 and 143 of the lever 140.

A plate spring portion 144 extends from the operating portion 141 and generates a repulsive force against the body portion 122 of the counterpart insulator 120. Since this repulsive force causes the operating portion 141 of the lever 140 to receive a force in a direction of an arrow 150 in FIG. 1, the operating portion 141 of the lever 140 is constantly biased away from the counterpart insulator 120.

Upon fitting together the connector 1 and the counterpart connector 100, the counterpart fitting portion 121 is inserted into the fitting hole 2. Then, the counterpart contacts 110 are brought into contact with the contacts 10, and the guide post portions 123 and 124 are inserted into the post holes 3 and 4, respectively. When the counterpart connector 100 is further inserted, arrowhead portions (not shown) of the levers 140 get into the lock holes 70 of the shell 60, respectively, thereby to achieve a locked state.

For releasing the locked state, pushing the operating portions 141 of the levers 140 causes rotation of the levers 140 against the repulsive forces of the plate spring portions 144 so that the projected arrowhead portions rotate in directions of arrows 151 in FIG. 1 so as to be retracted from the lock holes 70, respectively, thereby to release the locked state with the shell 60. By pulling the counterpart connector 100 while pushing the operating portions 141, it can be removed.

The foregoing contacts 10 are used for the purpose of contacting with the counterpart contacts 110 of the counterpart connector 100 so as to transmit electrical signals. The ground plate 20 is used for the purpose of contacting with the ground shell of the counterpart connector 100 so as to transmit a ground signal of the device body. The shell 60 is used for the purpose of protecting the signal contacts from noise inside and outside the device for which the connector 1 is used. The terminal portions 14 of the contacts 10, the ground terminal portions 26 of the ground plate 20, and the shell terminal portions 76 of the shell 60 are, for example, fixed to a board such as an LCD panel by soldering.

Upon fitting together the connector 1 and the counterpart connector 100, the ground plate 20 and the ground shell are connected to each other, in addition to the connection between the contacts 10 and the counterpart contacts 110. Therefore, the electrical signals from the electrical wires 160 are transmitted to the board such as the LCD panel via the counterpart contacts 110 and the contacts 10, while the ground signal is transmitted to the board such as the LCD panel via the ground shell and the ground plate 20.

Referring to FIGS. 8 to 12, a connector according to a second preferred embodiment of the present invention will be described. A connector 1' and a counterpart connector 100' shown in FIGS. 8 to 12 can employ structures similar to those of the connector 1 and the counterpart connector 100 shown in FIGS. 1 to 7, respectively. In FIGS. 8 to 12, those portions of the connector 1' and the counterpart connector 100' having substantially the same functions (shapes differ somewhat) as those of the connector 1 and the counterpart connector 100 shown in FIGS. 1 to 7 are assigned the same reference symbols to thereby omit description thereof.

The connector 1' is configured such that a shell 60 is mounted onto an insulator 40 from the back side in the second direction A2. Specifically, relative to the insulator 40, a ground plate 20 and the shell 60 are mounted from the same side in the second direction A2. Further, in the connector 1', the ground plate 20 does not require the first joining portion 21 that is required in the ground plate 20 of the connector 1.

Referring to FIGS. 13 to 16, a connector according to a third preferred embodiment of the present invention will be described. A connector 1" and a counterpart connector 100" shown in FIGS. 13 to 16 can employ structures similar to those of the connector 1 and the counterpart connector 100 shown in FIGS. 1 to 7, respectively. In FIGS. 13 to 16, those portions of the connector 1" and the counterpart connector 100" having substantially the same functions (shapes differ somewhat) as those of the connector 1 and the counterpart connector 100 shown in FIGS. 1 to 7 are assigned the same reference symbols to thereby omit description thereof.

In the connector 1", contacts 10 and a ground plate 20 are mounted into an insulator 40 in a direction opposite to an insert direction of the counterpart connector 100", then a shell 60 is mounted onto the insulator 40 in the same direction as the insert direction of the counterpart connector 100". These mounting directions are the same as those in the connector 1 shown in FIGS. 1 to 7.

Upon the mounting, insert portions 34 of the ground plate 20 formed at both ends thereof, serving as first connection pieces, are inserted into shell holes 51 of the insulator 40 from the back side in the second direction A2, while folded portions 63 of the shell 60, serving as second connection pieces, are inserted into the shell holes 51 from the front side in the second direction A2.

Each insert portion 34 of the ground plate 20 is formed with a dowel 35. The dowels 35 contact with the folded portions 63, respectively, so that the ground plate 20 and the shell 60 are electrically connected to each other. It is preferable that at least one of the insert portion 34 and the folded portion 63 is given springiness so as to press the dowel 35 against the folded portion 63 using this springiness. However, it is possible to ensure a predetermined contact by the use of the dowel 35 without providing the springiness. The dowel may be provided on at least one of the insert portion 34 and the folded portion 63.

Referring to FIGS. 17 to 24, a connector according to a fourth preferred embodiment of the present invention will be described. In FIGS. 17 to 24, portions like those in FIGS. 1 to 7 may be assigned the same reference symbols to thereby omit description thereof.

Soldering terminals 14 of signal contacts 10, a pair of soldering terminals 26 of a ground plate 20, and a pair of soldering terminals 76 of a shell 60, of a connector 1, are soldered to a board (not shown) such as an LCD panel. After connection to electrical wires 160, contacts 110 are fixed to an insulator 120. Upon fitting together the connector 1 and a counterpart connector 100, a connecting portion 121 is inserted into a fitting hole 2, and guide post portions 123 and 124 are inserted into post holes 3 and 4, respectively. In this event, the contacts 10 of the connector 1 and the contacts 110 of the counterpart connector 100 are connected together, respectively, and the ground plate 20 of the connector 1 and a ground shell of the counterpart connector 100 are connected together. Therefore, electrical signals from the electrical wires 160 are transmitted to the board such as the LCD panel via the respective contacts 110 and 10, while a ground signal is transmitted to the board such as the LCD panel via the ground shell and the ground plate 20.

Each contact 10 of the connector 1 is formed by pressing a metal plate. A press-fit portion 11 of each contact 10 is press-fitted into the insulator 40. A spring portion 12 and a contacting portion 13 at its free end are formed on one side of the press-fit portion 11, while the soldering terminal 14 is formed on the other side thereof.

The ground plate 20 is formed into an L-shape by a vertical portion 21 and a horizontal portion 22 over the whole length of the connector 1 in the first direction A1. A lot of press-fit portions 23 and spring portions 24 extend from the horizontal portion 22. A contacting portion 25 is formed at a free end of each spring portion 24 so as to be curved toward the contact 10. Each of ground contacts 32 comprises the press-fit portion 23, the spring portion 24, and the contacting portion 25. The contacting portions 25 are connected to the ground shell of the counterpart connector 100. The soldering terminals 26 are formed near both ends, in the first direction A1, of the vertical portion 21 and each of them extends from the vertical portion 21 in a direction opposite to that of the spring portion 24.

Figure 21:
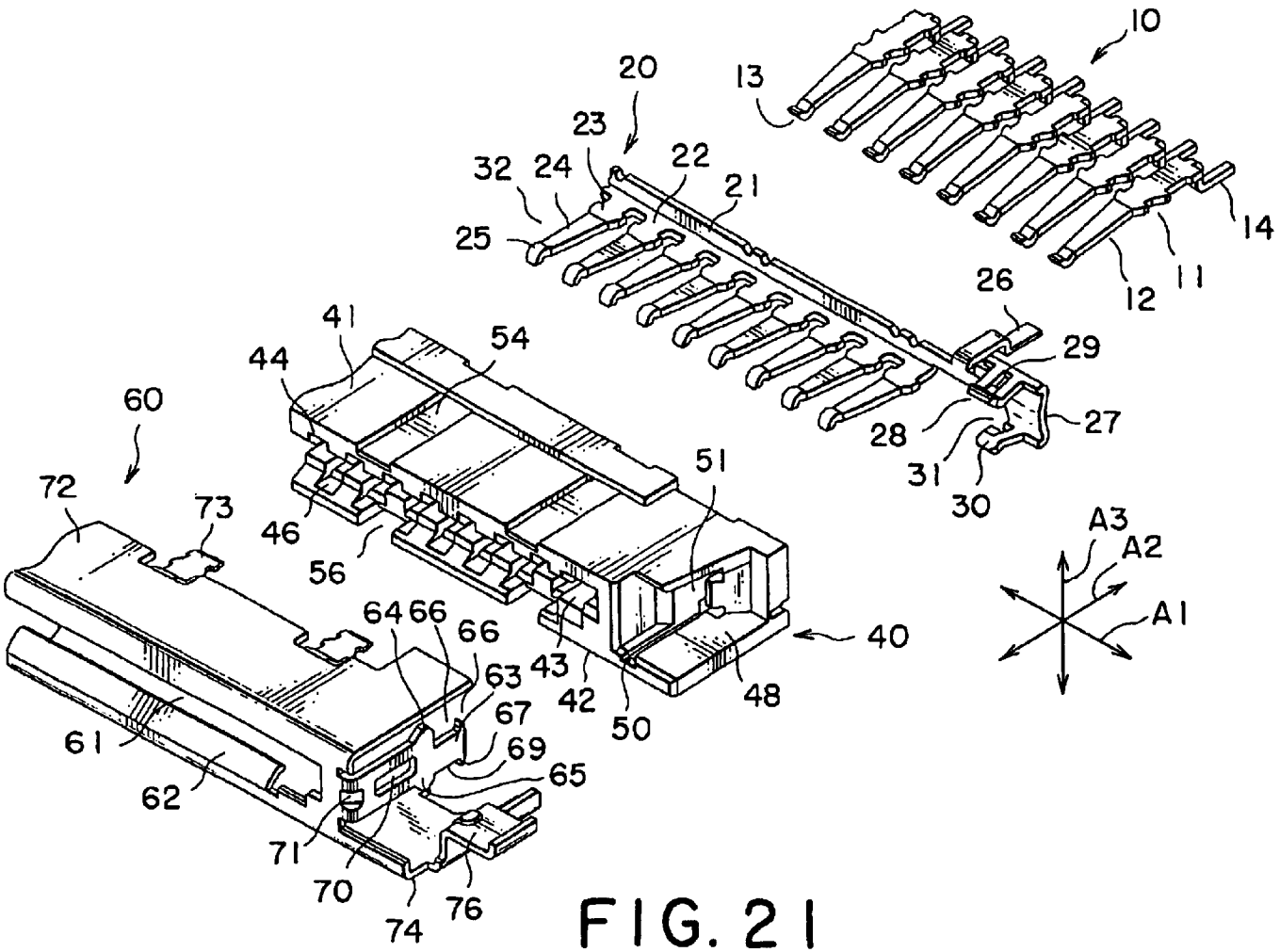
FIG. 21 is an enlarged perspective view of part of the connector shown in FIG. 18, wherein a shell of the connector is partly omitted.

Clip portions 27 are formed at both ends, in the first direction A1, of the ground plate 20. As shown in FIG. 21, each clip portion 27 has an upper spring portion 28 and a lower spring portion 30 that extend in the same direction as each spring portion 24. The upper spring portion 28 is provided with a hole portion 29, while the lower spring portion 30 is provided with a cutout 31.

The insulator 40 is made of a non-conductive material such as resin. As shown in FIGS. 18, 20, 21, 23, and 24, a fitting hole 43 is formed between an upper surface portion 41 and a lower surface portion 42 of the insulator 40. The upper surface portion 41 is formed with a lot of contact grooves 44. The lower surface portion 42 is formed with a lot of ground plate grooves 46.

A contact receiving hole 45 is formed on the longitudinally rear side of each contact groove 44, while a ground receiving hole 47 is formed on the longitudinally rear side of each ground plate groove 46.

Figure 18:
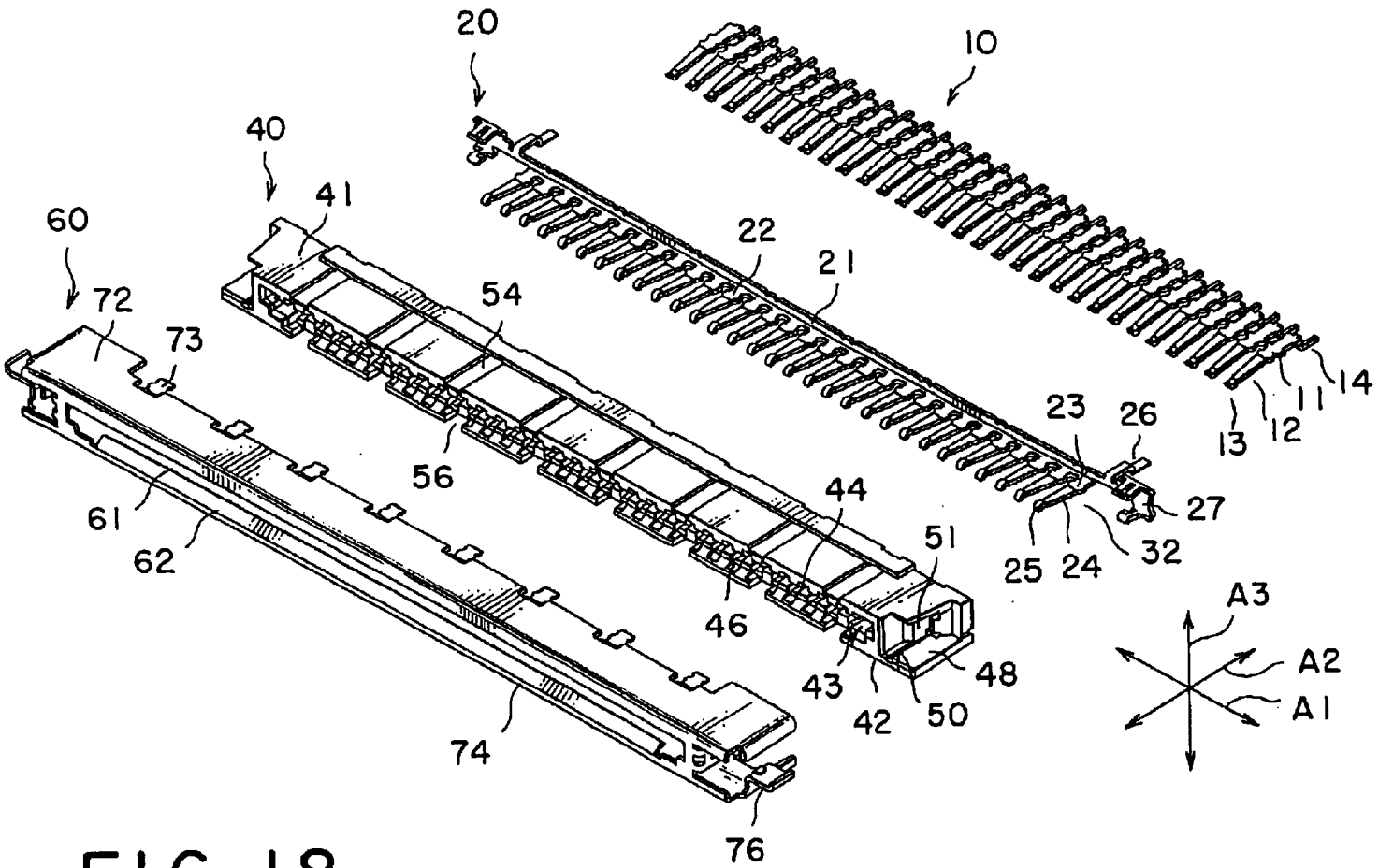
FIG. 18 is an exploded perspective view of the connector shown in FIG. 17.
Figure 19:
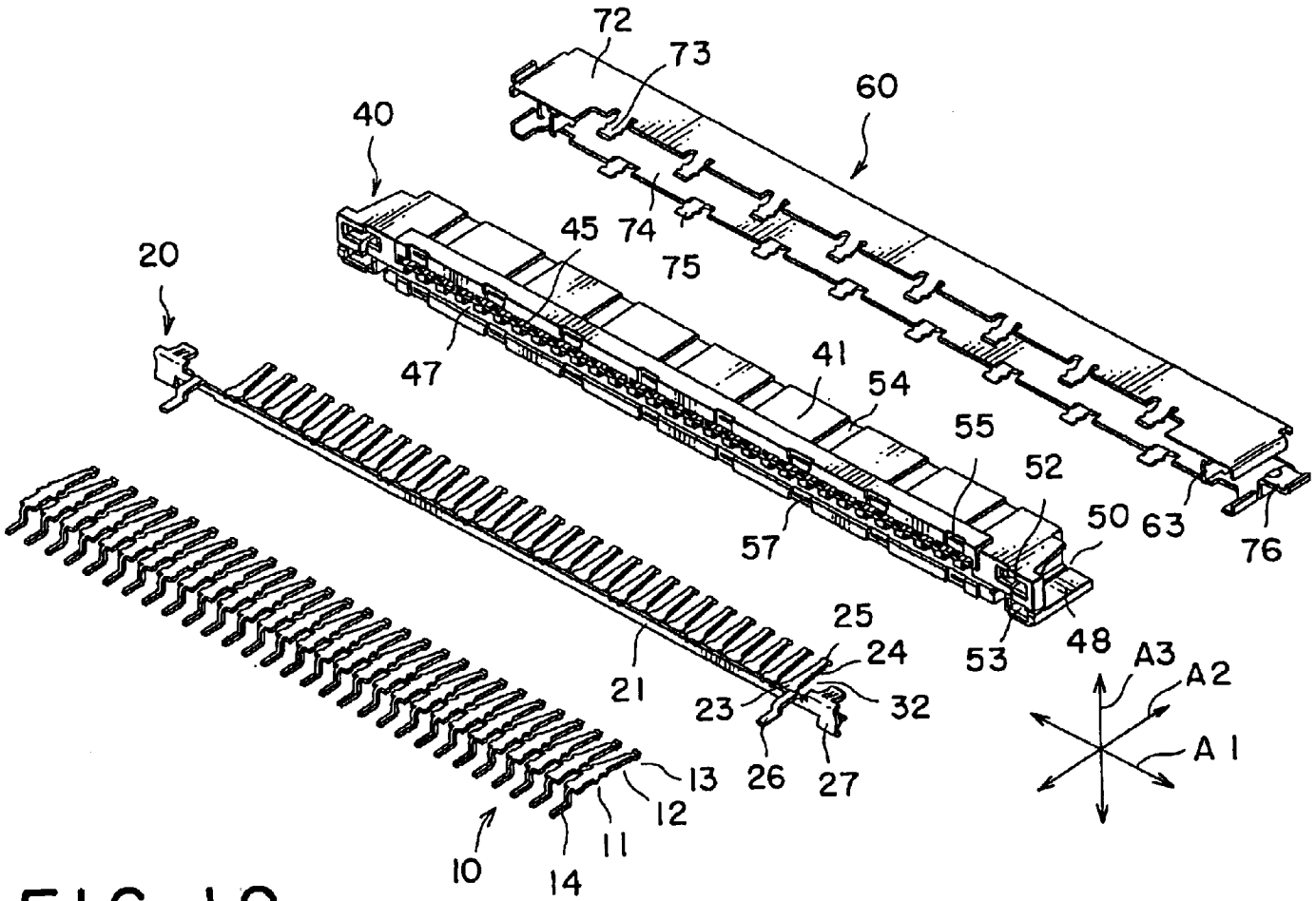
FIG. 19 is an exploded perspective view seen from the back side of the connector shown in FIG. 17.
Figure 20:
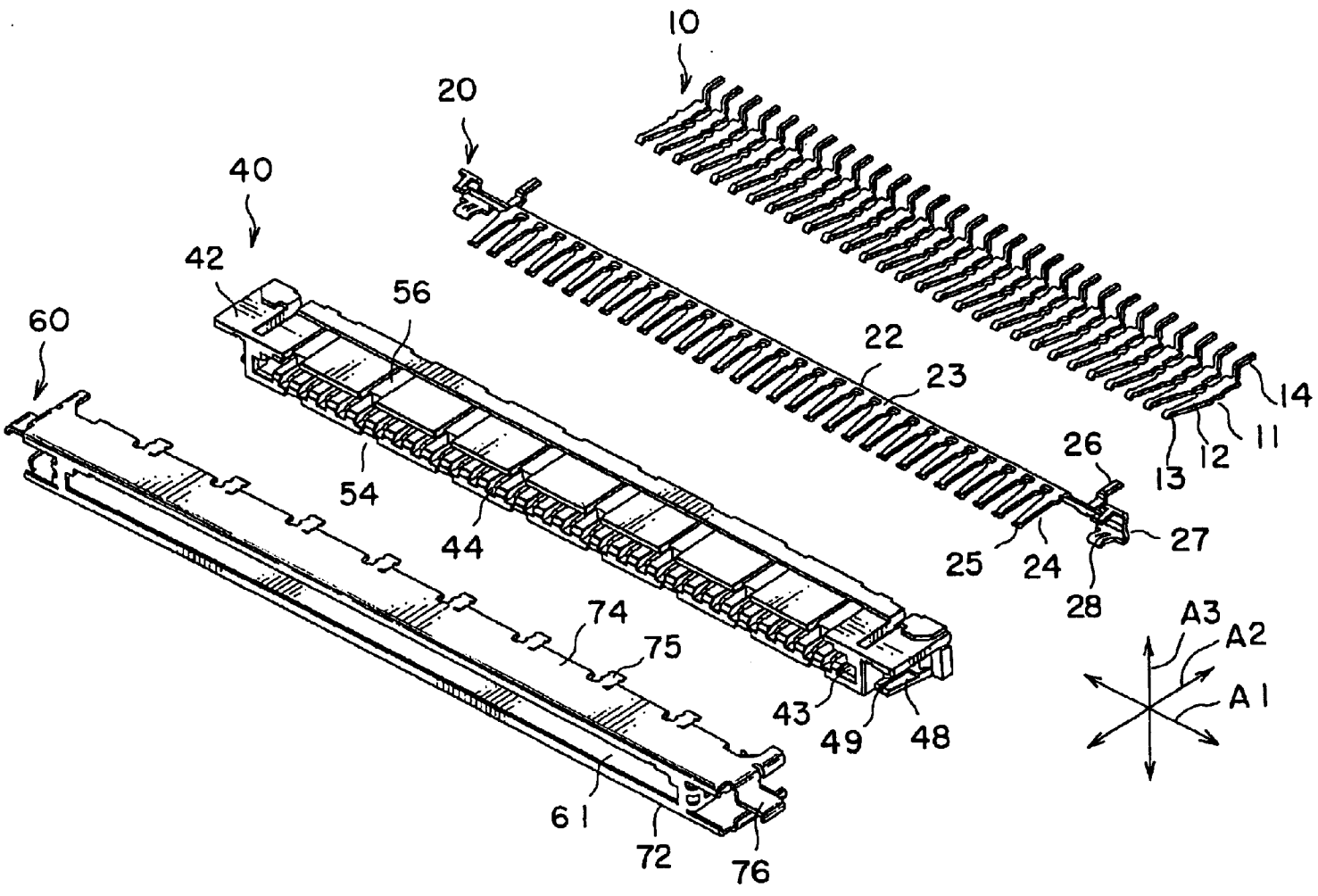
FIG. 20 is an exploded perspective view seen from the lower side of the connector shown in FIG. 17.
Figure 22:
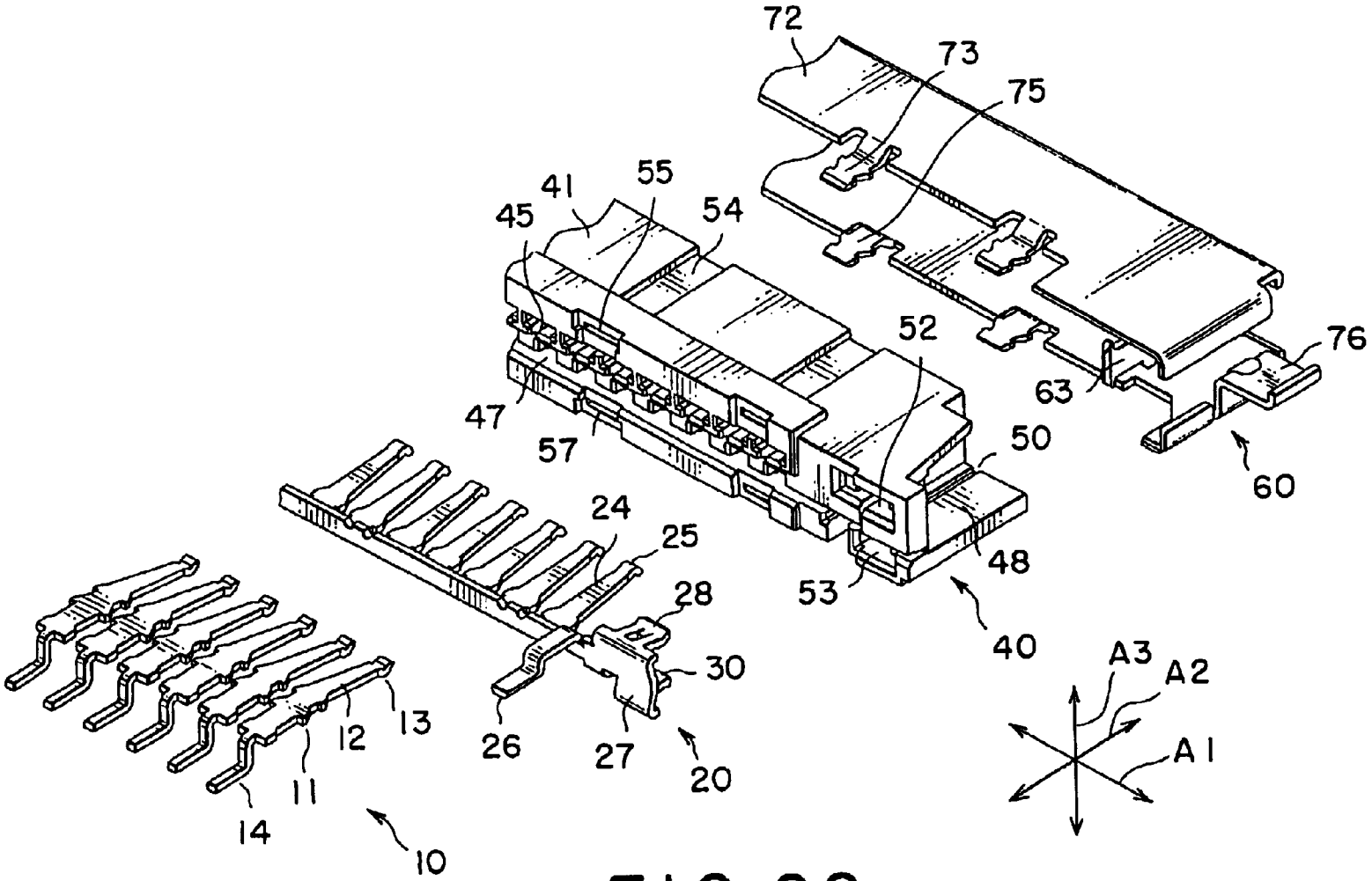
FIG. 22 is an enlarged perspective view of part of the connector shown in FIG. 19.

Recessed portions 48 are provided at both ends of the insulator 40 in the first direction A1. As shown in FIG. 20, a groove 49 is formed on an upper wall surface, in the third direction A3, of each recessed portion 48. As shown in FIGS. 18, 19, 21, and 22, a groove 50 is formed on a lower wall surface of each recessed portion 48. As shown in FIGS. 18 and 21, a shell hole 51 is formed in a back wall of each recessed portion 48. As shown in FIGS. 19 and 22, a hole 52 is formed in the back wall at a longitudinally rear end of each groove 49, and a hole 53 is formed in the back wall at a longitudinally rear end of each groove 50.

As shown in FIGS. 18 to 22, some shell grooves 54 are formed on the upper surface portion 41 of the insulator 40, and some shell grooves 56 are formed on the lower surface portion 42 thereof. As shown in FIGS. 19 and 22, shell holes 55 and 57 are formed at longitudinally rear ends of the shell grooves 54 and 56, respectively.

As shown in FIG. 18, the shell 60 is formed by pressing a metal plate into a substantially ⊐-shape in a section, and provided with a fitting hole 61 in the front thereof and with a guide surface 62 on a lower side of the fitting hole 61.

Figure 23:
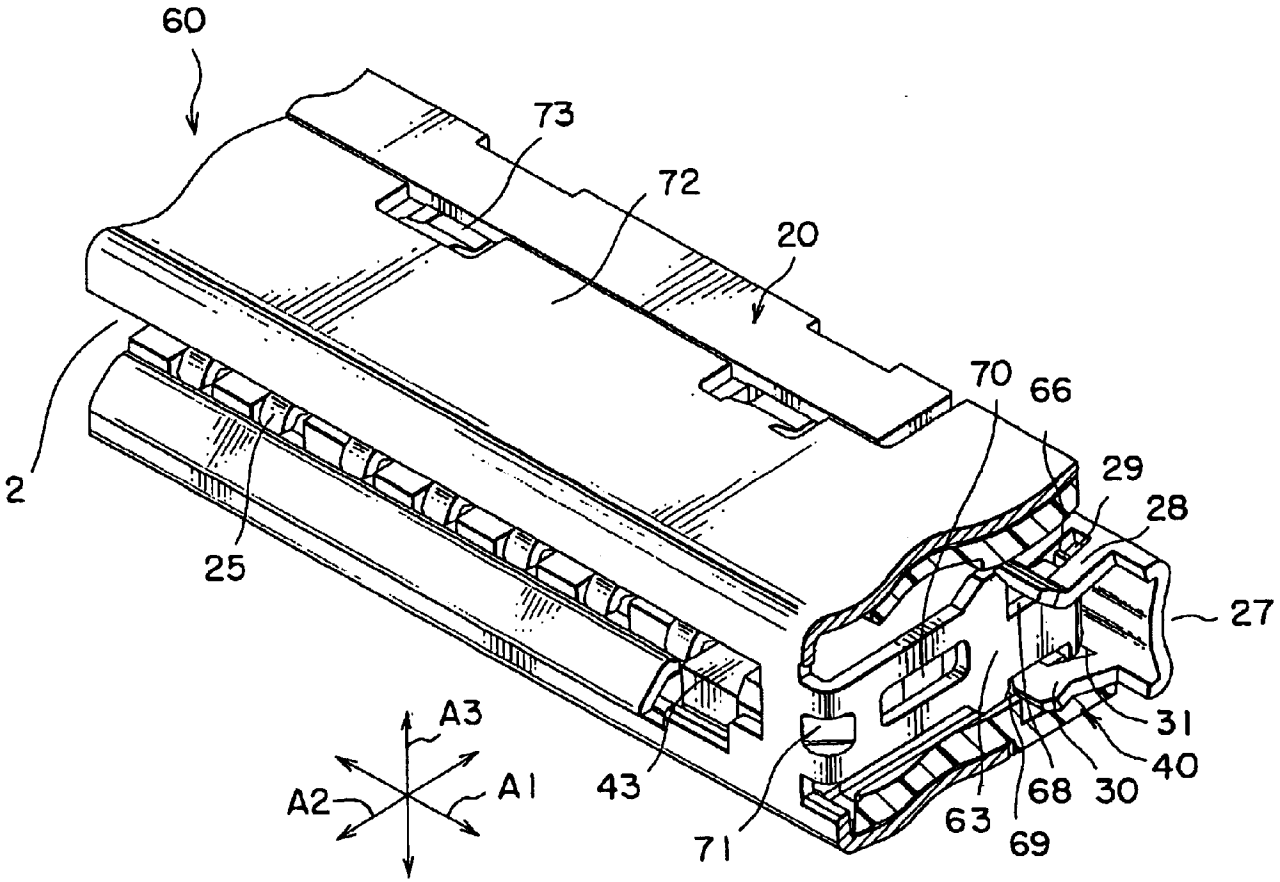
FIG. 23 is a perspective view of a section of a lock structure in the connector shown in FIG. 17.

As shown in FIGS. 21 and 23, folded portions 63 are formed by bending on both right and left outer sides of the fitting hole 61. Each folded portion 63 is provided with convex portions 64 and 65 near its center in the second direction A2, edges 66 and 67 at a free end thereof, and concave portions 68 and 69 between the convex portions 64 and 65 and the edges 66 and 67. Further, a lock hole 70 and a rib 71 are provided on a more root side of each folded portion 63 with respect to the convex portions 64 and 65.

As shown in FIGS. 19 and 22, an upper surface portion 72 of the shell is provided with some press-fit portions 73, and a lower surface portion 74 thereof is provided with some press-fit portions 75. Both ends, in the first direction A1, of the lower surface portion 74 are extended to serve as the soldering terminals 76, respectively.

Assembling of the connector 1 will be carried out in the following manner.

The contacts 10 are press-fitted into the contact holes 45, respectively, from the back side of the insulator 40 shown in FIGS. 19 and 22, thereby to be fixed in the state of being arrayed in one line in a constant pitch.

As shown in FIG. 19, the ground plate 20 is mounted into the insulator 40 from its back side in the second direction A2 so that the press-fit portions 23 are press-fitted into the ground receiving holes 47, respectively, so as to be fixed. In this event, as shown in FIGS. 21 to 23, the upper spring portions 28 of the clip portions 27 are fitted into the holes 52 of the insulator 40, respectively, and the lower spring portions 30 are fitted into the holes 53, respectively.

As shown in FIGS. 18 and 19, the shell 60 is mounted onto the insulator 40 from its front side in the second direction A2 so that the press-fit portions 73 and 75 of the shell 60 pass through the shell grooves 54 and 56 of the insulator 40 so as to be press-fitted into the shell holes 55 and 57 and thus fixed.

As shown in FIGS. 19 to 22, upon mounting the shell 60 onto the insulator 40, the convex portions 64 enter the grooves 49, respectively, and the convex portions 65 enter the grooves 50, respectively. Therefore, each folded portion 63 is fixed in position in the first direction A1, while the free end thereof passes through the shell hole 51.

When the folded portion 63 passes through the shell hole 51, the edge 66 passes through the upper spring portion 28 of the clip portion 27 of the ground plate 20 and then, as shown in FIG. 23, enters the hole portion 29 of the clip portion 27 so that the upper spring portion 28 comes in contact with the convex portion 68. On the other hand, the edge 67 passes through the lower spring portion 30 and then enters the cutout 31 so that the lower spring portion 30 comes in contact with the concave portion 69.

As a result, the ground plate 20 is electrically connected to the shell 60 via the clip portions 27 and the folded portions 63. In this event, the upper spring portion 28 and the lower spring portion 30 of the clip portion 27 serve as a first connection piece, while the folded portion 63 serves as a second connection piece.

Levers 140 are attached to the insulator 120 after the electrical wirings 160 and the contacts 110 are press-connected together, respectively.

The ground shell (not shown) is mounted onto the back side of the connecting portion 121 of the insulator 120. At both right and left ends of a body portion 122 of the insulator 120, the levers 140 are mounted so as to be pivotable about the pins 130, respectively. Each lever 140 is formed by pressing a metal plate. The lever 140 has side portions serving as an operating portion 141 to be operated by fingers, and is attached to the body portion 122 so as to sandwich the body portion 122 between upper and lower surface portions 142 and 143 of the lever 140. A plate spring 144 is received in each lever 140 and urges the lever 140 in a direction of an arrow 150 by contacting with the body portion 122.

Figure 24:
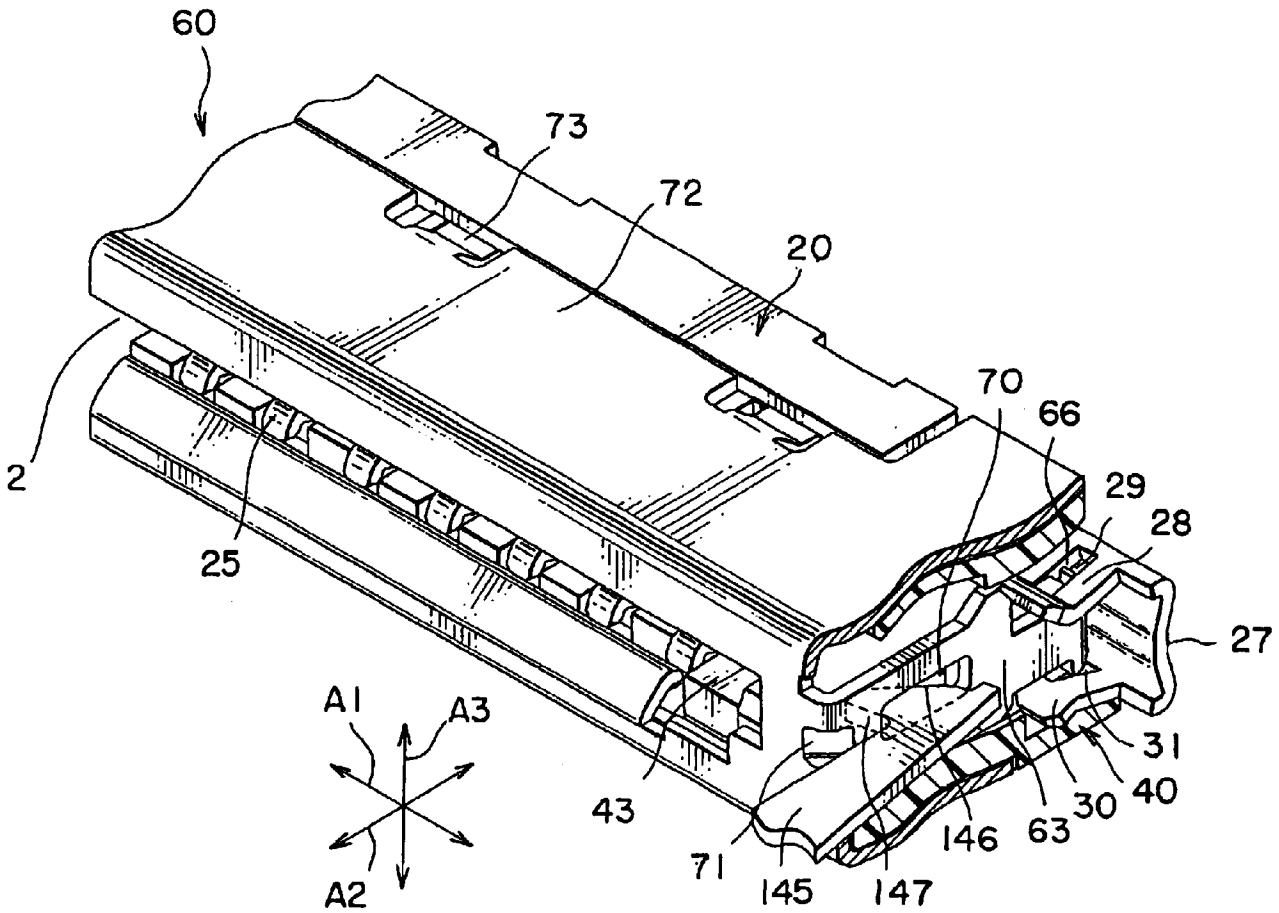
FIG. 24 is a perspective view of a section of the lock structure in the state wherein the connector and the counterpart connector shown in FIG. 17 are locked together.

As shown in FIG. 24, a forward end side 145 of each lever 140 is inserted into the inside of the guide post portion 123,124 when mounted onto the insulator 120, and an inclined portion 146 and a hook portion 147 of the forward end side 145 are projected from the inside of the guide post portion 123, 124.

Upon fitting together the connector 1 and the counterpart connector 100, the connecting portion 121 is inserted into the fitting hole 2 so that the contacts 110 contact with the contacts 10, respectively, and the guide post portions 123 and 124 are inserted into the post holes 3 and 4, respectively. In this event, when the inclined portion 146 of each lever 140 passes over the rib 71 of the shell 60, the inclined portion 146 and the hook portion 147 of the forward end side 145 are retracted into the inside of the guide post portion 123, 124 against the plate spring 144.

When the counterpart connector 100 is further inserted into the connector 1, the hook portion 147 of each lever 140 gets into the lock hole 70 of the shell 60 as shown in FIG. 24 so that the counterpart connector 100 is locked with the connector 1.

For removing the counterpart connector 100 from the connector 1, an operation is carried out in the following manner. When the operating portions 141 of the levers 140 are pushed by fingers, the levers 140 rotate in directions of arrows 151 in FIG. 17, respectively, against repulsive forces of the plate springs 144 so that the hook portions 147 are retracted from the lock holes 70, respectively. Therefore, the locked state of the counterpart connector 100 and the connector 1 is released. By pulling the counterpart connector 100 from the connector 1 while pushing the operating portions 141 by fingers, the counterpart connector 100 is removed from the connector 1.

Even if pulling the counterpart connector 100 from the connector 1 without pushing the operating portions 141 of the levers 140, since the hook portions 147 of the levers 140 engage with the lock holes 70 of the shell 60, removal of the counterpart connector 100 from the connector 1 is impossible.

In the connector 1, the edges 66 and 67 of the shell 60 engage with the hole portions 29 and the cutouts 31 of the ground plate 20, respectively. Therefore, when an excessive pulling force is applied to the counterpart connector 100, the pulling force is transmitted not only to the shell 60 but also to the ground plate 20 so that the ground plate 20 is pulled by the pulling force.

The ground plate 20 is mounted into the insulator 40 from its back side that is opposite to the side from which the shell 60 is mounted onto the insulator 40. Accordingly, when the ground plate 20 is pulled by the pulling force, it collides against the insulator 40. The ground plate 20 and the contacts 10 are mounted into the insulator 40 from its back side in the second direction A2, and the soldering terminals 26 of the ground plate 20 and the soldering terminals 14 of the contacts 10 are soldered to the board. Therefore, the pulling force applied to the counterpart connector 100 is received by the whole connector 1 including press-fit retaining forces of the shell 60, the respective contacts 10, and the ground plate 20 relative to the insulator 40, and peel strengths of the soldering terminals 76, 14, and 26 of the shell 60, the respective contacts 10, and the ground plate 20, and hence, breakage of the hook portions 147 of the levers 140 and the lock holes 70 of the shell 60 becomes more unlikely.

Since the concave portions 68 and 69 of the shell 60 are brought into contact with the upper spring portions 28 and the lower spring portions 30 of the ground plate 20, respectively, the shell 60 and the ground plate 20 are electrically connected to each other. The ground signal flowing in the ground plate 20 flows to the board via the soldering terminals 26, while the ground signal also flows to the soldering terminals 76 of the shell 60 via the contacting portions between the ground plate 20 and the shell 60, and therefore, the transmission paths of the ground signal are increased to thereby improve the electrical performance.

The description has been given about the case wherein the press-fit portions 73 and 75 are provided for fixing the shell 60 relative to the insulator 40. However, inasmuch as the engaging portions of the shell 60 and the to-be-engaged portions of the ground plate 20 engage with each other to thereby cause the shell 60 to be fixed so as to cover the insulator 40, the press-fit portions 73 and 75 of the shell 60 ad the shell holes 55 and 57 of the insulator 40 may be omitted.

While the present invention has thus far been described in connection with a few embodiments thereof, it will readily be possible for those skilled in the art to put this invention into practice in various other manners. For example, it is readily understood that those embodiments can be suitably combined and that such combinations are also included within the scope of the present invention.

What is claimed is:

1. An electrical connector comprising:

a plurality of conductive signal contacts arrayed in a first direction for contacting with signal contacts of a counterpart connector;

a conductive ground plate comprising a plurality of first ground contacts arrayed in said first direction for contacting with second ground contacts of the counterpart connector, and a joining portion joining said first ground contacts together;

an insulator retaining said first signal contacts and said ground plate so as to be spaced apart from each other;

a conductive shell formed separately from said ground plate and covering said insulator; and a connection structure electrically connecting said joining portion to said shell, said connection structure comprising a first connection piece extending from a part of said joining portion in the same direction as each of said first ground contacts in a second direction perpendicular to said first direction, and contacting with said shell.

2. An electrical connector according to claim 1, wherein each of said first ground contacts is substantially parallel to said first connection piece.

3. An electrical connector according to claim 1, wherein said ground plate comprises a ground terminal extending from said joining portion in a direction opposite to that of said first connection piece in said second direction.

4. An electrical connector according to claim 1, wherein said first connection piece has springiness and is pressed against said shell by said springiness.

5. An electrical connector according to claim 4, wherein said first connection piece is pressed against said shell in a third direction perpendicular to said first and second directions.

6. An electrical connector according to claim 4, wherein said first connection piece is pressed against said shell in said first direction.

7. An electrical connector according to claim 1, wherein said connection structure comprises a second connection piece extending from said shell in said second direction and contacting with said first connection piece.

8. An electrical connector according to claim 7, wherein at least one of said first and second connection pieces has a dowel that is pressed against the other of said first and second connection pieces.

9. An electrical connector according to claim 7, wherein said first and second connection pieces engage with each other in said second direction.

10. An electrical connector according to claim 9, wherein said ground plate and said shell are fitted to said insulator from mutually opposite sides in said second direction.

11. An electrical connector according to claim 9, wherein said ground plate and said shell are fitted to said insulator from the same side in said second direction.

12. An electrical connector comprising:

a plurality of signal contacts;

a ground plate;

an insulator retaining said signal contacts and said ground plate; and a shell covering said insulator, wherein said shell has an engaging portion and said ground plate has a to-be-engaged portion, and wherein said shell is mounted to said insulator in an insert direction of a counterpart connector into said connector and said ground plate is mounted to said insulator in a direction opposite to said insert direction so that said engaging portion and said to-be-engaged portion engage with each other.

13. An electrical connector according to claim 12, wherein said ground plate has a spring portion and said to-be-engaged portion is formed at said spring portion so that said shell and said ground plate are connected to each other through engagement between said engaging portion and said to-be-engaged portion.

14. An electrical connector according to claim 12, wherein said ground plate comprises a plurality of ground contacts, and said ground contacts are connected to a ground shell of said counterpart connector.

15. An electrical connector according to claim 12, wherein said engaging portion has a lock portion that locks connection to said counterpart connector.

* * * * *

UNITED STATES PATENT AND TRADEMARK OFFICE

CERTIFICATE OF CORRECTION

PATENT NO. : 6,890,193 B2
DATED : May 10, 2005
INVENTOR(S) : Kimura et al.

It is certified that error appears in the above-identified patent and that said Letters Patent is hereby corrected as shown below:

Title page,
Item [30], Foreign Application Priority Data, please add as follows:
-- April 24, 2003 (JP)……...120498/2003 --.
-- April 23, 2003 (JP)……118486/2003 --.

Signed and Sealed this

Sixth Day of September, 2005

JON W. DUDAS
*Director of the United States Patent and Trademark Office*

US006890193C1

(12) EX PARTE REEXAMINATION CERTIFICATE (7700th)

United States Patent
Kimura et al.

(10) Number: US 6,890,193 C1
(45) Certificate Issued: Aug. 24, 2010

(54) ELECTRICAL CONNECTOR IMPROVING BOTH FUNCTIONS OF MAGNETIC SHIELDING AND GROUND CONNECTION

(75) Inventors: Akira Kimura, Kokubunji (JP); Kazuhito Hisamatsu, Akiruno (JP); Masaaki Takaku, Tokyo (JP)

(73) Assignee: Japan Aviation Electronics Industry, Limited, Shibuya-Ku, Tokyo (JP)

Reexamination Request:
No. 90/009,118, Apr. 21, 2008

Reexamination Certificate for:

| | |
|---|---|
| Patent No.: | **6,890,193** |
| Issued: | **May 10, 2005** |
| Appl. No.: | **10/673,944** |
| Filed: | **Sep. 29, 2003** |

Certificate of Correction issued Sep. 6, 2005.

(30) Foreign Application Priority Data

Apr. 23, 2003 (JP) ..... 118486
Apr. 24, 2003 (JP) ..... 120498

(51) Int. Cl.

| | |
|---|---|
| ***H01R 12/16*** | (2006.01) |
| ***H01R 12/00*** | (2006.01) |
| ***H01R 13/658*** | (2006.01) |

(52) U.S. Cl. ..... 439/108

(58) Field of Classification Search ..... None
See application file for complete search history.

(56) References Cited

U.S. PATENT DOCUMENTS

| | | | | |
|---|---|---|---|---|
| 5,073,130 A | * | 12/1991 | Nakamura | 439/607 |
| 5,921,811 A | * | 7/1999 | Hsu | 439/567 |
| 6,053,773 A | * | 4/2000 | Wu | 439/609 |
| 6,273,753 B1 | * | 8/2001 | Ko | 439/579 |
| 6,315,616 B1 | * | 11/2001 | Hayashi | 439/638 |

* cited by examiner

*Primary Examiner*—Linh M. Nguyen

(57) ABSTRACT

An insulator (40) retains a plurality of conductive signal contacts (10) arrayed in a first direction (A1) for contacting with signal contacts of a counterpart connector, and further retains a conductive ground plate (20). The ground plate is arranged so as to be spaced apart from the signal contacts and has a plurality of ground contacts (24, 25) for contacting with ground contacts of the counterpart connector. These ground contacts are arrayed in the first direction and joined to each other via a joining portion (21). A connection piece (32, 33) extends from a part of the joining portion in the same direction as each of the ground contacts. The connection piece contacts with a conductive shell (60) formed separately from the ground plate and covering the insulator.

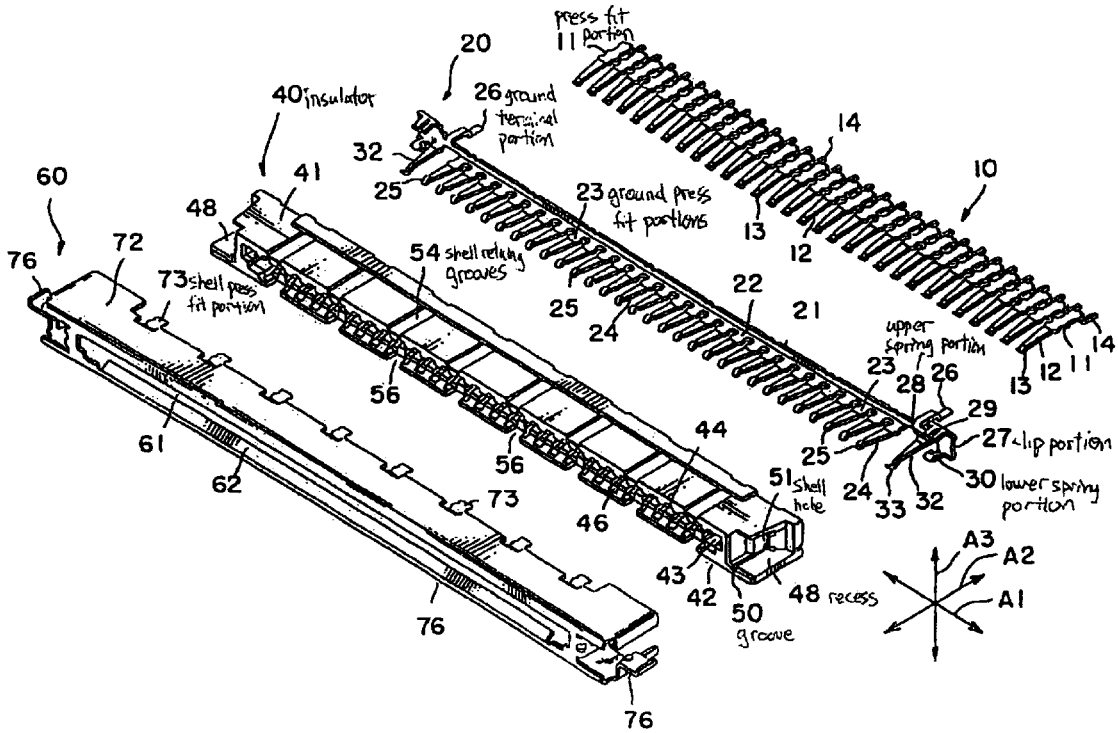

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 13 is cancelled.

Claims 1 and 12 are determined to be patentable as amended.

Claims 2–11 and 14–15, dependent on an amended claim, are determined to be patentable.

1. An electrical connector comprising:

a plurality of conductive signal contacts arrayed in a first direction for contacting with signal contacts of a counterpart connector;

a conductive ground plate comprising a plurality of first ground contacts arrayed in said first direction for contacting with second ground contacts of the counterpart connector, and a joining portion joining said first ground contacts together;

an insulator retaining said first signal contacts and said ground plate so as to be spaced apart from each other, *said insulator having a slit*;

a conductive shell formed separately from said ground plate and covering said insulator; and a connection structure electrically connecting said joining portion to said shell, said connection structure comprising a first connection piece extending from a part of said joining portion in the same direction as each of said first ground contacts in a second direction perpendicular to said first direction, [and contacting] *said first connection piece being inserted in said slit and protruding from said insulator to come into contact* with said shell.

12. An electrical connector comprising:

a plurality of signal contacts;

a ground plate;

an insulator retaining said signal contacts and said ground plate; and a shell covering said insulator, wherein said shell has an engaging portion and *a pair of concave portions opposite to each other,*

*wherein* said ground plate has a *first and a second spring portions which are formed with the first and a second* to-be-engaged [portion] *portions*, [and] *respectively,* wherein said shell is mounted to said insulator in an insert direction of a counterpart connector into said connector and

*wherein* said ground plate is mounted to said insulator in a direction opposite to said insert direction so that [said engaging portion and said to-be-engaged portion engage with each other] *said first and said second spring portions come into contact with said concave portions, respectively, to make said first and said second to-be-engaged portions be engaged with said engaging portion.*

* * * * *